US011117766B2

(12) United States Patent
Osawa

(10) Patent No.: US 11,117,766 B2
(45) Date of Patent: Sep. 14, 2021

(54) MULTI-FEED DETECTION DEVICE AND ELECTRONIC DEVICE

(71) Applicant: Seiko Epson Corporation, Tokyo (JP)

(72) Inventor: Eiji Osawa, Chino (JP)

(73) Assignee: Seiko Epson Corporation

( * ) Notice: Subject to any disclaimer, the term of this patent is extended or adjusted under 35 U.S.C. 154(b) by 138 days.

(21) Appl. No.: 16/406,314

(22) Filed: May 8, 2019

(65) Prior Publication Data

US 2019/0344987 A1 Nov. 14, 2019

(30) Foreign Application Priority Data

May 9, 2018 (JP) ..... JP2018-090390

(51) Int. Cl.
*B65H 7/12* (2006.01)

(52) U.S. Cl.
CPC ..... *B65H 7/125* (2013.01); *B65H 2511/13* (2013.01); *B65H 2553/30* (2013.01); *B65H 2553/822* (2013.01)

(58) Field of Classification Search
CPC ..... B65H 7/125; B65H 7/12; B65H 2553/30; B65H 2553/822; B65H 2511/13
See application file for complete search history.

(56) References Cited

U.S. PATENT DOCUMENTS 4,117,732 A 10/1978 Brazhnikov
4,446,735 A 5/1984 Weilacher
5,621,173 A 4/1997 Knorr
5,922,960 A 7/1999 Toda
7,130,245 B2 10/2006 Okitsu et al.
7,748,274 B2 * 7/2010 Pellaton ..... G07D 7/08 73/649
7,819,400 B2 10/2010 Miyoshii et al.
8,448,517 B2 5/2013 Itsumi et al.
8,931,777 B2 1/2015 Okitsu
9,561,522 B2 2/2017 Knorr
2005/0127597 A1 6/2005 Sano et al.
2007/0018376 A1 1/2007 Sano et al.
2007/0034008 A1 2/2007 Voss
2008/0203654 A1 8/2008 Chujo et al.
2011/0317230 A1 * 12/2011 Tanaka ..... H04N 1/00687 358/498
2012/0025458 A1 * 2/2012 Simonis ..... B65H 7/20 271/262

(Continued)

FOREIGN PATENT DOCUMENTS

CN 1625208 A 6/2005
DE 20 2005 010 037 U1 9/2005

(Continued)

*Primary Examiner* — Luis A Gonzalez
(74) *Attorney, Agent, or Firm* — Harness, Dickey & Pierce, P.L.C.

(57) ABSTRACT

A multi-feed detection device includes a transmission circuit substrate to which an ultrasonic transmitter transmitting an ultrasonic wave is installed, and an ultrasonic receiver receiving the ultrasonic wave. The ultrasonic transmitter has arrayed ultrasonic transmission elements and transmits ultrasonic waves with different phases from the ultrasonic transmission elements to transmit the ultrasonic waves in a direction diagonally intersecting a thickness direction of the transmission circuit substrate.

4 Claims, 16 Drawing Sheets

(56) References Cited

U.S. PATENT DOCUMENTS

| | | | | |
|---|---|---|---|---|
| 2012/0061901 | A1 | 3/2012 | Yamamoto et al. | |
| 2013/0111995 | A1* | 5/2013 | Koehler | G01N 29/2487 73/598 |
| 2013/0191042 | A1* | 7/2013 | Lavrentyev | G01N 29/2456 702/39 |
| 2014/0091516 | A1 | 4/2014 | Okitsu | |
| 2017/0108472 | A1* | 4/2017 | Fischer | G01N 29/32 |
| 2017/0212083 | A1* | 7/2017 | Georgeson | G01N 29/221 |
| 2018/0120261 | A1* | 5/2018 | Hsieh | B60L 58/10 |
| 2019/0329999 | A1* | 10/2019 | Osawa | G01B 17/02 |
| 2019/0344987 | A1 | 11/2019 | Osawa | |
| 2019/0344988 | A1* | 11/2019 | Osawa | G01N 29/27 |

FOREIGN PATENT DOCUMENTS

| | | | |
|---|---|---|---|
| JP | H05-010932 | A | 1/1993 |
| JP | H05-056851 | U | 7/1993 |
| JP | 2008-074610 | A | 4/2008 |
| JP | 5770848 | B2 | 8/2015 |

* cited by examiner

MULTI-FEED DETECTION DEVICE AND ELECTRONIC DEVICE

The present application is based on and claims priority from JP Application Serial Number 2018-090390, filed May 9, 2018, the disclosure of which is hereby incorporated by reference herein in its entirety.

BACKGROUND

1. Technical Field

The present disclosure relates to a multi-feed detection device and an electronic device.

2. Related Art

Devices which handle a rectangular sheet-like medium are widely used, for example, printing devices which print a character or an image on a medium such as paper and electronic devices such as a scanner which reads an image printed on a medium. Such devices stock a plurality of media and transport the media one by one. When only one sheet of paper is extracted from the plurality of media and transported, a roller or the like having a surface on which rubber is installed is used.

Here, since the frictional resistance between the plurality of media varies due to the influence of humidity or the like, the plurality of media may be transported at the same time. Transport of the plurality of media is called multi-feed. JP-UM-A-5-56851 discloses a method of detecting multi-feed. According to JP-UM-A-5-56851, an ultrasonic transmitter and an ultrasonic receiver are installed in the device. The ultrasonic transmitter transmits an ultrasonic wave, and the ultrasonic receiver receives the ultrasonic wave.

A medium passes between the ultrasonic transmitter and the ultrasonic receiver. When the medium is irradiated with the ultrasonic wave, a portion of the ultrasonic wave reflects on the medium, and a portion of the ultrasonic wave is absorbed by the medium. Further, a portion of the ultrasonic wave passes through the medium. As the number of media increases, the ultrasonic wave is absorbed by the medium and thus an intensity of the ultrasonic wave passing through the medium decreases. Accordingly, by comparing the intensity of the ultrasonic wave received by the ultrasonic receiver with a determination value, it is possible to detect that a plurality of media are being passed through when the intensity of the ultrasonic wave is smaller than the determination value.

When an advancing direction of the ultrasonic wave transmitted from the ultrasonic transmitter is set in a thickness direction of the medium, the ultrasonic wave reflected on the medium returns to the ultrasonic transmitter. When the ultrasonic wave reciprocates between the ultrasonic transmitter and the medium, the ultrasonic wave transmitted from the ultrasonic transmitter and the reciprocating ultrasonic wave interfere with each other. Therefore, the intensity of the ultrasonic wave that the ultrasonic receiver receives fluctuates.

In order to suppress the ultrasonic wave from reciprocating between the ultrasonic transmitter and the medium, the advancing direction of the ultrasonic wave transmitted from the ultrasonic transmitter is set in a direction diagonally intersecting the thickness direction of the medium. The ultrasonic transmitter and the ultrasonic receiver are disposed on the same line. Here, a direction in which a line connecting the ultrasonic transmitter and the ultrasonic receiver extends diagonally intersects the surface of the medium. The ultrasonic transmitter and the ultrasonic receiver are fixed to a fixture, a member guiding the medium, or the like such that the advancing direction of the ultrasonic wave is diagonal to the advancing direction of the medium.

Then, a substrate is set so that the advancing direction of the medium is the planar direction of the substrate. Here, since the device is thin, it can be made into a small electronic device.

The medium advances parallel to the substrate. When installing the ultrasonic transmitter diagonally with respect to the substrate, a member for installing the ultrasonic transmitter diagonal to the substrate is required. Compared to when the side surface of the member is formed in parallel or at a right angle, it is difficult to form a diagonal angle with high accuracy. Accordingly, the variation in the angle of the ultrasonic transmitter with respect to the advancing direction of the medium increases. Therefore, there has been a demand for a multi-feed detection device capable of advancing the ultrasonic wave diagonally with respect to the advancing direction of a detection target even when it is not diagonally disposed with respect to the substrate.

SUMMARY

A multi-feed detection device according to an aspect of the present application includes a substrate to which an ultrasonic transmitter transmitting an ultrasonic wave is installed, and an ultrasonic receiver receiving the ultrasonic wave, in which the ultrasonic transmitter has arrayed ultrasonic elements and transmits ultrasonic waves with different phases from the ultrasonic elements to transmit the ultrasonic waves in a direction diagonally intersecting a thickness direction of the substrate.

The multi-feed detection device may further include a drive circuit for driving the ultrasonic elements, in which the drive circuit may control a phase of an ultrasonic wave transmitted from each of the ultrasonic elements to control an advancing direction of the ultrasonic wave.

In the multi-feed detection device, the ultrasonic receiver may include a plurality of ultrasonic receiving elements, and the plurality of ultrasonic receiving elements may receive the ultrasonic waves transmitted from the ultrasonic transmitter and the ultrasonic receiver may output an electrical signal corresponding to an intensity of the ultrasonic wave received by the ultrasonic receiving element which receives an ultrasonic wave with a strongest intensity among the plurality of ultrasonic receiving elements.

In the multi-feed detection device, the ultrasonic receiver may be installed to a receiving substrate disposed parallel to the substrate, and the ultrasonic receiving elements are arrayed in a direction orthogonal to a thickness direction of the receiving substrate.

An electronic device according to another aspect of the present application includes a multi-feed detection device installed in a transport path of a detection target and detecting whether or not two or more of the detection targets are overlapped, in which the multi-feed detection device is the multi-feed detection device described above.

DESCRIPTION OF EXEMPLARY EMBODIMENTS

Hereinafter, embodiments will be described with reference to the drawings. In order to make each member in each drawing to be recognizable to each figure, the scale of each member is shown differently.

First Embodiment

Figure 1:
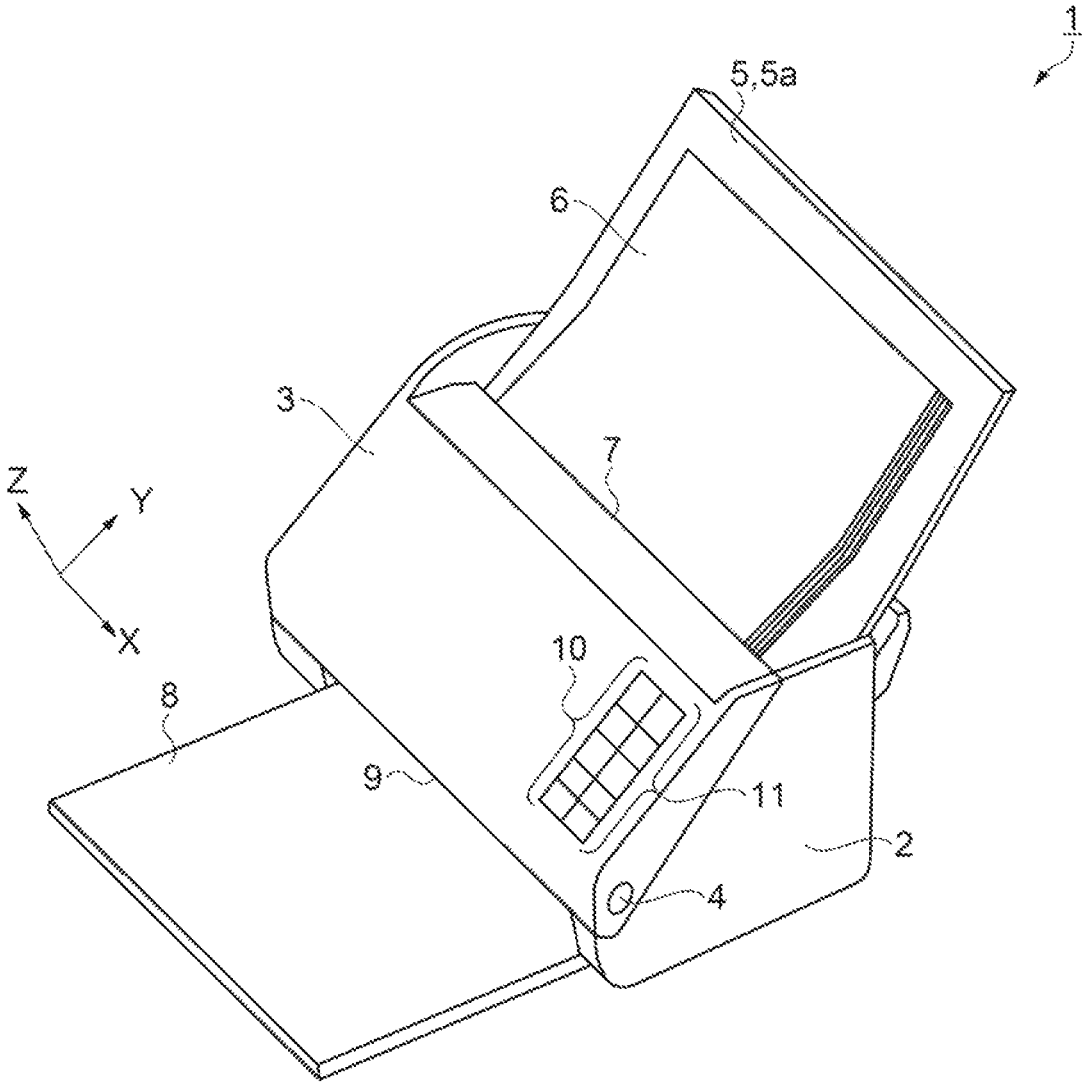
FIG. 1 is a schematic perspective diagram showing a configuration of a scanner according to a first embodiment.

In the present embodiment, a characteristic example of a scanner including a multi-feed detection device and a method of assembling the scanner will be described with reference to the drawings. The scanner according to the first embodiment will be described with reference to FIGS. 1 to 12. The scanner is a device which reads an image drawn on a medium such as paper, and also called an image reading device. The medium is the detection target on which the multi-feed detection device performs multi-feed detection. FIG. 1 is a schematic perspective diagram showing a configuration of the scanner. As shown in FIG. 1, a scanner 1 as an electronic device includes a lower case 2 and an upper case 3. The lower case 2 and the upper case 3 are openably and closably coupled with each other by a hinge 4.

On a right upper side of the lower case 2 in FIG. 1, a cover portion 5 is pivotably attached to the lower case 2. A surface of the cover portion 5 on the upper case 3 side is a paper placing surface 5*a*. A plurality of sheets of paper 6 are placed as a detection target on the paper placing surface 5*a*. The paper 6 has a rectangular shape, and the plurality of sheets of paper 6 have the same shape. A material of the paper 6 may be made of various types of resin material other than paper or synthetic paper. An opening feeding port 7 is disposed between the paper placing surface 5*a* and the upper case 3. The paper 6 is transported into the scanner 1 from the feeding port 7.

An advancing direction of the paper 6 is referred to as a −Y direction. A width direction of the paper 6 is referred to as an X direction. A direction in which the paper 6 is stacked is referred to as a Z direction. The X direction, a Y direction, and the Z direction are orthogonal to each other.

A paper discharge tray 8 is installed on the −Y direction side of the lower case 2. An opening discharge port 9 is disposed in the lower case 2 between the paper discharge tray 8 and the upper case 3. The paper 6 enters into the scanner 1 from the feeding port 7 and is discharged from the discharge port 9. The paper 6 discharged from the discharge port 9 is stacked on the paper discharge tray 8. In a path through which the paper 6 moves, the cover portion 5 side is referred to as upstream, and the paper discharge tray 8 side is referred to as downstream.

An indication lamp 10 and an instruction button 11 are disposed on a +X direction side of the upper case 3. The indication lamp 10 includes a light source such as a light emitting diode (LED). The indication lamp 10 can be turned on, blinked, and turned off. The indication lamp 10 notifies an operator of predetermined information to, such as power on/off, currently selected mode, presence or absence of multi-feed detection, by turning on or off the indication lamp or by changing the color of the lamp.

The instruction button 11 includes a plurality of button-type switches for giving instructions to the scanner 1. The instruction button 11 is a switch for the operator to operate. Specifically, the instruction button 11 is configured of various switches such as a power switch, a start switch, a stop switch, a reading mode selection switch, and a switch for wireless communication.

The power switch is a switch for giving an instruction to switch supply and disconnection of power to the scanner 1. The start switch is a switch for giving an instruction to start transport of the paper 6. The stop switch is a switch for giving a stop instruction to interrupt or cancel a job started by the operation of the start switch. The reading mode selection switch is a switch for instructing a reading mode such as a color mode and image quality. The color mode includes, for example, a monochrome mode and a color mode. The switch for wireless communication is a switch for giving an instruction to switch on/off of the wireless communication.

Figure 2:
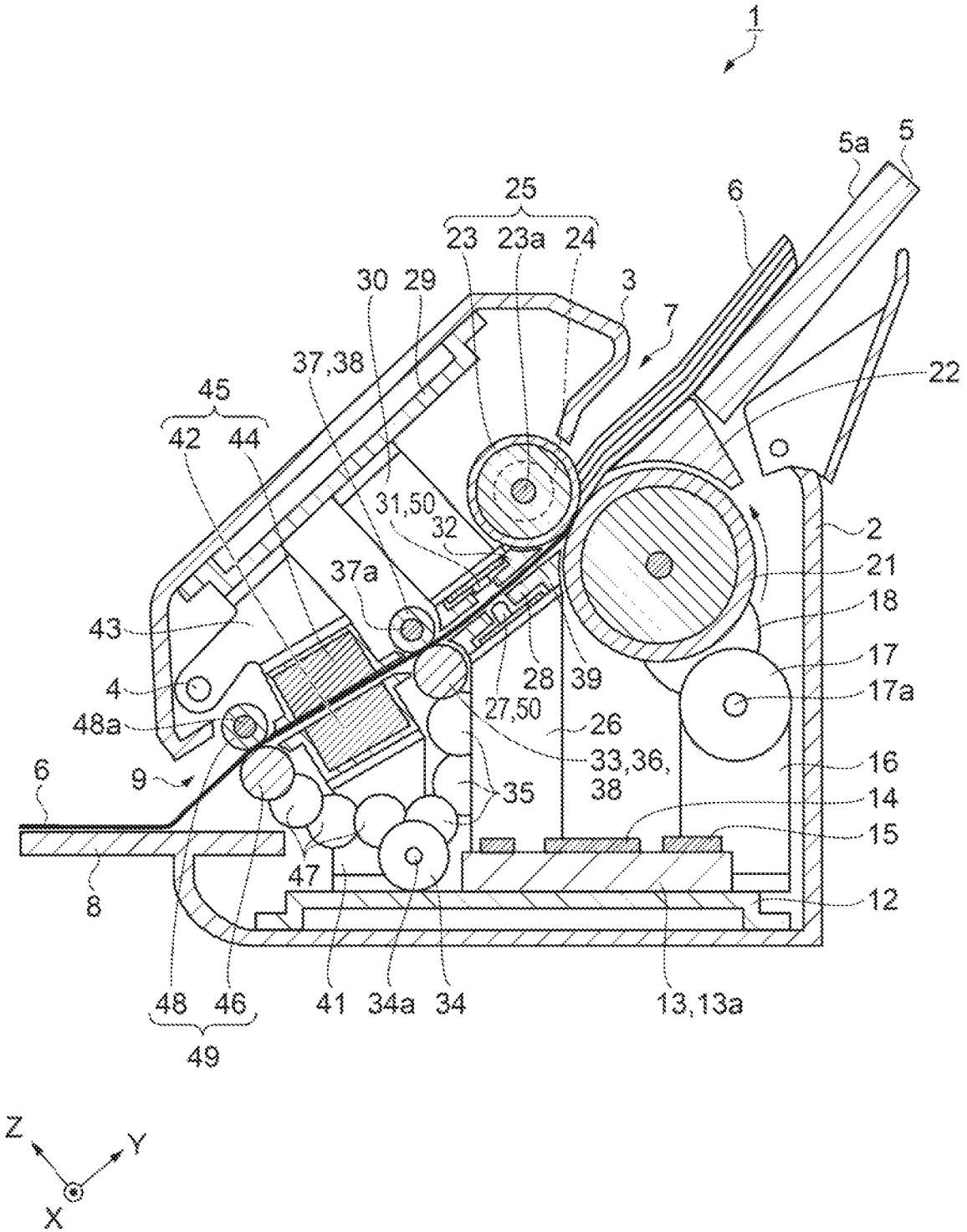
FIG. 2 is a schematic side sectional diagram showing a structure of the scanner.

FIG. 2 is a schematic side sectional diagram showing a structure of the scanner. As shown in FIG. 2, a lower substrate 12 is installed at the bottom inside the lower case 2. The lower substrate 12 is a galvanized steel sheet having rigidity. A control unit 13 is installed on the lower substrate 12. The control unit 13 is configured of an electric circuit for controlling the operation of the scanner 1. The control unit 13 includes a circuit substrate 13*a*, and electric circuit elements such as a central processing unit 14 (CPU) and a memory 15 are installed on the circuit substrate 13*a*.

A feed motor 17 supported by a first support portion 16 is installed on the lower substrate 12. A first wheel train 18 and a feed roller 21 are disposed on a +Z direction side of the feed motor 17. A tooth form is formed on a rotation shaft 17*a* of the feed motor 17 and gears of the first wheel train 18, respectively. A gear is installed in the feed roller 21.

When the feed motor 17 rotates the rotation shaft 17*a*, the torque generated by the feed motor 17 is transmitted to the feed roller 21 via the first wheel train 18. Thereby, the feed roller 21 rotates. An outer circumferential surface of the feed roller 21 is, for example, made of a high friction material such as an elastomer including rubber.

An upstream guide portion 22 is installed between the feed roller 21 and the cover portion 5. The upstream guide portion 22 is connected with the lower case 2. The paper 6 is placed on the upstream guide portion 22 and the cover portion 5. The upstream guide portion 22 and the cover portion 5 support the paper 6.

A separation roller 23 is installed on the +Z direction side of the feed roller 21. The separation roller 23 is disposed at a position facing the feed roller 21. The outer circumferential surface of the separation roller 23 is, like the feed roller 21, for example, made of a high friction material such as an elastomer including rubber.

The paper 6 placed on the upstream guide portion 22 moves in the −Y direction by the gravity acting on the paper 6. Then, an end of the paper 6 comes into contact with the separation roller 23. When the feed roller 21 is rotating in a counterclockwise direction in FIG. 2, the paper 6 being in contact with the upstream guide portion 22 enters between the feed roller 21 and the separation roller 23.

A shaft 23*a* of the separation roller 23 is biased by a spring (not shown). The separation roller 23 is pressed by the feed roller 21. A torque limiter 24 is installed on the shaft 23*a*. A separation mechanism 25 is configured of the separation roller 23 and the torque limiter 24.

When only one sheet of paper 6 is sandwiched between the feed roller 21 and the separation roller 23, the feed roller 21 and the separation roller 23 rotate together to transport the paper 6. A coil spring is installed in the torque limiter 24. As the shaft 23*a* rotates, the coil spring is bent to a predetermined angle so that the torque limiter 24 stores a predetermined torque.

When two sheets of paper 6 are sandwiched between the feed roller 21 and the separation roller 23, the torque limiter 24 rotates the separation roller 23 by a predetermined angle in a direction different from the feed roller 21. Friction between the sheets of paper 6 is smaller than friction between the paper 6 and the feed roller 21, and is smaller than friction between the paper 6 and the separation roller 23. Accordingly, the overlapped paper 6 easily slides against each other. The feed roller 21 transports the paper 6 in contact with the feed roller 21 in the −Y direction, and the separation roller 23 moves the paper 6 in contact with the separation roller 23 in a +Y direction. Then, only one sheet of paper 6 is transported between the feed roller 21 and the separation roller 23. In this way, the separation mechanism 25 separates the overlapped paper 6. When three or more sheets of paper 6 are pinched between the feed roller 21 and the separation roller 23, the feed roller 21 may transport two or more sheets of paper 6.

A second support portion 26 is installed in the middle of the lower substrate 12 in FIG. 2, and an ultrasonic receiver 27 and a midstream lower guide portion 28 are installed on the second support portion 26. The ultrasonic receiver 27 is a device that receives an ultrasonic wave and converts the ultrasonic wave into an electrical signal. The midstream lower guide portion 28 guides the paper 6 passed through the feed roller 21.

An upper substrate 29 is installed on the +Z direction side inside the upper case 3. The upper substrate 29 is a galvanized steel sheet having rigidity. A third support portion 30 is installed in the middle of the upper substrate 29 in FIG. 2, and an ultrasonic transmitter 31 and a midstream upper guide portion 32 are installed on the third support portion 30. The ultrasonic transmitter 31 is a device which transmits an ultrasonic wave toward the ultrasonic receiver 27. The midstream upper guide portion 32 is disposed to face the midstream lower guide portion 28 and guides the paper 6 passed through the feed roller 21. A multi-feed detection device 50 is configured of the ultrasonic receiver 27, the ultrasonic transmitter 31, and the like. The multi-feed detection device 50 detects whether or not two or more sheets of paper 6 are overlapped.

A transport drive roller 33 is installed on the −Y direction side of the midstream lower guide portion 28. A transport motor 34 for rotating the transport drive roller 33 is installed on the left side of the control unit 13 in FIG. 2. A second wheel train 35 is disposed between the transport drive roller 33 and the transport motor 34. A tooth form is formed on a rotation shaft 34*a* of the transport motor 34 and the gears of the second wheel train 35, respectively. A gear is installed in the transport drive roller 33.

When the transport motor 34 rotates the rotation shaft 34*a*, the torque generated by the transport motor 34 is transmitted to the transport drive roller 33 via the second wheel train 35. Thereby, the transport drive roller rotates. A transport encoder 36 is installed in the transport drive roller 33, and the transport encoder 36 detects a rotation angle of the transport drive roller 33.

A transport driven roller 37 is disposed to face the transport drive roller 33 on the +Z direction side of the transport drive roller 33. A shaft 37*a* of the transport driven roller 37 is biased to the transport drive roller 33 side by a spring (not shown). A pair of transport rollers 38 is configured of the transport drive roller 33 and the transport driven roller 37. The paper 6 passed between the midstream lower guide portion 28 and the midstream upper guide portion 32 is sandwiched between the pair of transport rollers 38 and transported in the −Y direction.

A fourth support portion 41 is installed on the lower substrate 12 on the left side of the second support portion 26 in FIG. 2. A lower reading unit 42 is installed on the fourth support portion 41. A fifth support portion 43 is installed on the upper substrate 29 on the −Y direction side of the third support portion 30. An upper reading unit 44 is installed on the fifth support portion 43. An image reading device 45 is configured of the lower reading unit 42, the upper reading unit 44, and the like. For example, a contact image sensor module (CISM) is installed in the lower reading unit 42 and the upper reading unit 44.

The hinge 4 is installed on the fifth support portion 43. The hinge 4 is also connected to a sixth support portion (not shown) installed on the lower substrate 12. The lower substrate 12 and the upper substrate 29 pivot about the hinge 4 as an axis. The scanner 1 includes a fixed portion (not shown) which pivotably fixes the lower case 2 and the upper case 3. The fixed portion fixes the upper case 3 and the lower case 2 in a state where the upper case 3 is closed.

A discharge drive roller 46 is installed on the −Y direction side of the lower reading unit 42. A third wheel train 47 is disposed between the discharge drive roller 46 and the transport motor 34. A tooth form is formed on each gear of the third wheel train 47. A gear is installed in the discharge drive roller 46.

When the transport motor 34 rotates the rotation shaft 34*a*, the torque generated by the transport motor 34 is transmitted to the discharge drive roller 46 via the third wheel train 47. Thereby, the discharge drive roller 46 rotates.

A discharge driven roller 48 is disposed to face the discharge drive roller 46 on the +Z direction side of the discharge drive roller 46. A shaft 48*a* of the discharge driven roller 48 is biased to the discharge drive roller 46 side by a spring (not shown). A pair of discharge rollers 49 is configured of the discharge drive roller 46 and the discharge driven roller 48. The paper 6 passed through the pair of discharge rollers 49 is transported on the paper discharge tray 8 from the discharge port 9. A path through which the paper 6 is passed between the cover portion 5 and the paper discharge tray 8 is a transport path 39. The multi-feed detection device 50 is installed in the transport path 39 of the paper 6.

Figure 3:
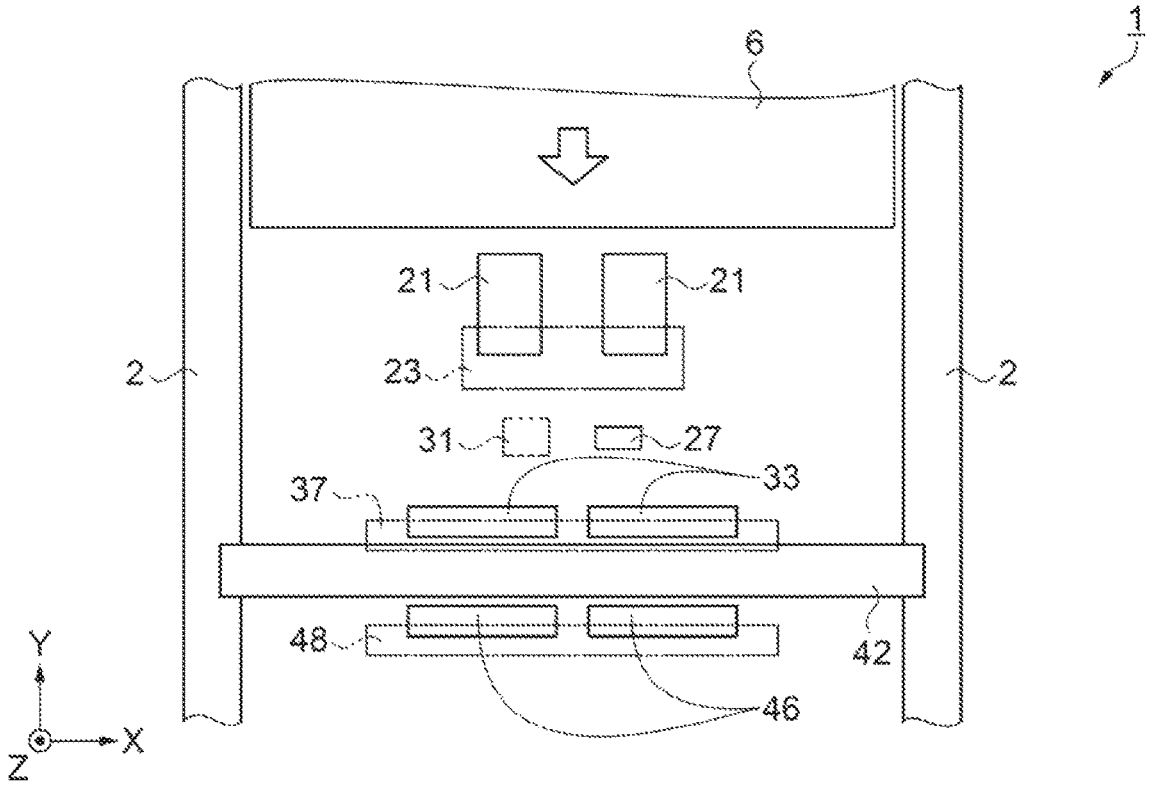
FIG. 3 is a schematic plan diagram showing the structure of the scanner.

FIG. 3 is a schematic plan diagram showing a structure of the scanner, and a diagram of the scanner 1 seen from the Z side along the transport path 39 of the paper 6. As shown in FIG. 3, two of each feed roller 21, transport drive roller 33, and discharge drive roller 46 are disposed side by side in the X direction. The separation roller 23 is disposed to face two feed rollers 21. The transport driven roller 37 is disposed to face two transport drive rollers 33. The discharge driven roller 48 is disposed to face two discharge drive rollers 46. The ultrasonic receiver 27 is disposed on the +X direction side of the scanner 1, and the ultrasonic transmitter 31 is disposed on a −X direction side of the scanner 1.

Figure 4:
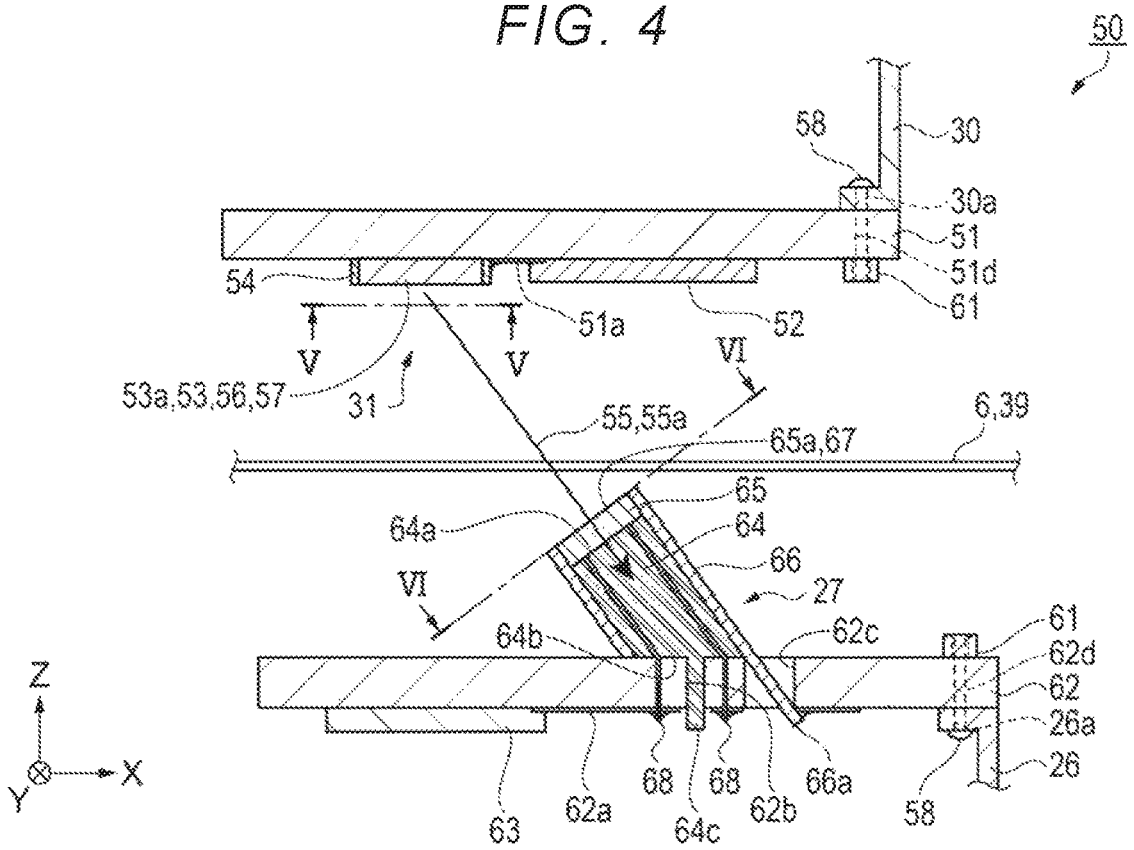
FIG. 4 is a schematic side sectional diagram showing a configuration of a multi-feed detection device.

FIG. 4 is a schematic side sectional diagram showing a structure of the multi-feed detection device, and is a diagram of the multi-feed detection device seen from the −Y direction side. As shown in FIG. 4, a multi-feed detection device 50 is installed in the transport path 39 of the paper 6. The multi-feed detection device 50 includes the ultrasonic transmitter 31 for transmitting the ultrasonic wave 55 and the ultrasonic receiver 27 for receiving the ultrasonic wave 55. The multi-feed detection device 50 includes a transmission circuit substrate 51 as a substrate, and the ultrasonic transmitter 31 transmitting an ultrasonic wave 55 is installed on the transmission circuit substrate 51. In addition, a transmission drive circuit 52 as a drive circuit for driving the ultrasonic transmitter 31 and a wiring 51*a* are also disposed on the transmission circuit substrate 51.

The ultrasonic transmitter 31 includes a transmission element substrate 53. The transmission element substrate 53 is fixed in contact with the transmission circuit substrate 51. A transmission shield 54 is installed on a side surface of the transmission element substrate 53. The shape of the transmission shield 54 is not particularly limited as long as it surrounds the transmission element substrate 53. The shape of the transmission shield 54 may be, for example, a cylindrical shape, a rectangular tube shape, a shape along a rectangular parallelepiped, a shape along a polyhedron, or the like. In the present embodiment, for example, the planar shape of the transmission element substrate 53 is rectangular, and the shape of the transmission shield 54 is cylindrical. The transmission shield 54 is chassis grounded via the wiring 51*a*, and the transmission element substrate 53 is shielded against static electricity and magnetic noise.

A surface of the transmission element substrate 53 facing the ultrasonic receiver 27 is referred to as a transmission surface 53*a*. An ultrasonic transmission element group 57 constituted of ultrasonic transmission elements 56 as an ultrasonic element driven by a drive signal is installed on the transmission surface 53*a*. The ultrasonic wave 55 is transmitted from the ultrasonic transmission elements 56. The ultrasonic transmitter 31 transmits the ultrasonic wave 55 in a direction diagonally intersecting a thickness direction of the transmission circuit substrate 51.

The ultrasonic transmission elements 56 are electrically connected to a wiring 51*a* with a wiring (not shown). The types of wiring between the ultrasonic transmitter 31 and the wiring 51*a* are not particularly limited, and a flexible printed circuit (FPC), wire bonding, a through electrode, or like can be used.

Furthermore, the transmission circuit substrate 51 includes a through-hole 51*d* on the +X direction side. A through-hole 30*a* is also installed on the third support portion 30. The screw 58 is inserted into the through-hole 51*d* and the through-hole 30*a* and is fixed by the nut 61.

The multi-feed detection device 50 includes a receiving circuit substrate 62 as a receiving substrate, and the ultrasonic receiver 27 for receiving the ultrasonic wave 55 is installed on the receiving circuit substrate 62. In addition, a receiving drive circuit 63 for driving the ultrasonic receiver 27 and a wiring 62*a* are disposed on the receiving circuit substrate 62.

The ultrasonic receiver 27 includes a receiving pedestal 64. The shape of the receiving pedestal 64 is not particularly limited, and it may be cylindrical, prismatic, rectangular parallelepiped, or polyhedral. In the present embodiment, for example, the shape of the receiving pedestal 64 is cylindrical. The receiving pedestal 64 has a first surface 64*a* and a second surface 64*b* facing each other. The first surface 64*a* is a surface orthogonal to the cylindrical axis, and the second surface 64*b* is a surface diagonally intersecting the cylindrical axis. A receiving element substrate 65 is installed on the first surface 64*a*. The second surface 64*b* is fixed in contact with the receiving circuit substrate 62.

Two cylindrical projection portions 64*c* are installed side by side in the Y direction on the second surface 64*b* of the receiving pedestal 64. Two through-holes 62*b* are installed side by side in the Y direction on the receiving circuit substrate 62. Two projection portions 64*c* are inserted into the through-holes 62*b*, respectively. The receiving pedestal 64 is disposed on the receiving circuit substrate 62 with high positional accuracy by the projection portions 64*c* and the through-holes 62*b*.

A receiving shield 66 is installed on a side surface of the receiving pedestal 64. The shape of the receiving shield 66 is not particularly limited as long as it surrounds the receiving pedestal 64. The shape of the receiving shield 66 may be, for example, a cylindrical shape, a rectangular tube shape, a shape along a rectangular parallelepiped, a shape along a polyhedron, or the like. In the present embodiment, for example, the shape of the receiving shield 66 is a cylindrical shape. The receiving shield 66 has a projection portion 66*a* installed on the receiving circuit substrate 62 side. One through-hole 62*c* is installed on the receiving circuit substrate 62. The projection portion 66*a* is inserted into the through-hole 62*c*. The projection portion 66*a* is soldered to the wiring 62*a*. The receiving shield 66 is chassis grounded via the wiring 62*a*, and the receiving element substrate 65 is shielded against static electricity and magnetic noise.

A surface of the receiving element substrate 65 facing the ultrasonic transmitter 31 is referred to as a receiving surface 65*a*. The receiving surface 65*a* is a surface on which the ultrasonic receiver 27 receives the ultrasonic wave 55. Ultrasonic receiving elements 67 as ultrasonic elements for receiving the ultrasonic wave 55 are arranged in a matrix on the receiving surface 65*a*. Each of the ultrasonic receiving elements 67 receives the ultrasonic wave 55. Accordingly, the ultrasonic receiver 27 has a plurality of ultrasonic receiving elements 67 for receiving the ultrasonic wave 55.

A rod-like receiving element wiring 68 is installed in the receiving pedestal 64. The receiving element wiring 68 is connected to each of the ultrasonic receiving elements 67. The receiving element wiring 68 is electrically connected to the receiving drive circuit 63 via the wiring 62*a*. The receiving drive circuit 63 receives the reception voltage waveform output from the ultrasonic receiving elements 67 via the wiring 62*a* and the receiving element wiring 68. Two receiving element wirings 68 are shown for visibility of FIG. 4, but the number of receiving element wirings 68 may be three or more. An FPC may be used instead of the rod-like receiving element wiring 68.

The receiving circuit substrate 62 includes a through-hole 62*d* on the +X direction side. A through-hole 26*a* is also installed on the second support portion 26. The screw 58 is inserted into the through-hole 62*d* and the through-hole 26*a* and is fixed by the nut 61.

The paper 6 is transported between the ultrasonic receiver 27 and the ultrasonic transmitter 31. The ultrasonic transmitter 31 transmits the ultrasonic wave 55 in a direction diagonally intersecting a thickness direction of the transmission circuit substrate 51. Thereby, the ultrasonic receiver 27 receives the ultrasonic wave 55 passed through the paper 6.

Figure 5:
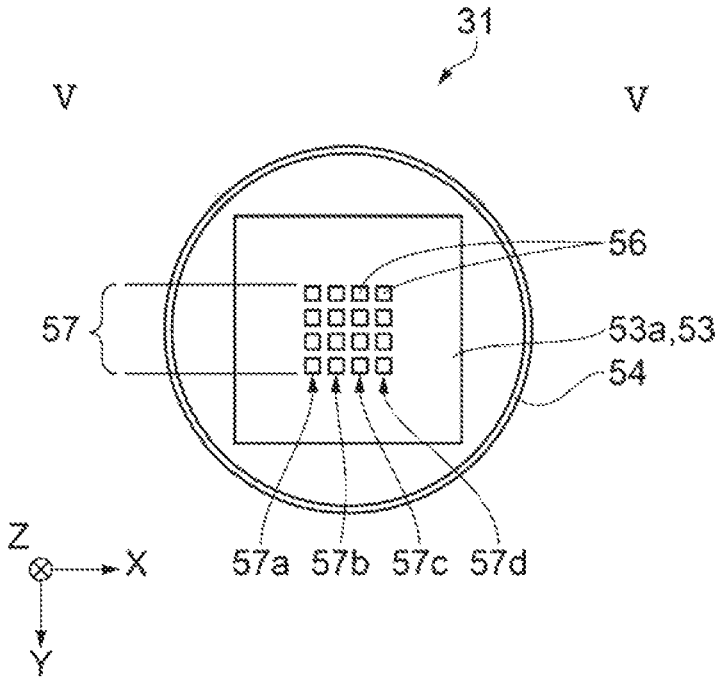
FIG. 5 is a schematic diagram for explaining a transmission surface of an ultrasonic transmitter.

FIG. 5 is a schematic diagram for explaining a transmission surface of an ultrasonic transmitter, and is a diagram as seen from a side of a surface along line V-V of FIG. 4. As shown in FIG. 5, the ultrasonic transmission element group 57 is installed on the transmission element substrate 53, and the ultrasonic transmission elements 56 are arranged in a matrix in the ultrasonic transmission element group 57. The number of ultrasonic transmission elements 56 in the ultrasonic transmission element group 57 may be three rows by three columns or more and is not particularly limited. For example, in the present embodiment, 16 ultrasonic transmission elements 56 of four rows and four columns are arranged in the ultrasonic transmission element group 57.

In the ultrasonic transmission element group 57, the row on the −X side is defined as a first column 57*a*. The columns aligned in the +X direction from the first column 57*a* are sequentially set as a second column 57*b*, a third column 57*c*, and a fourth column 57*d*. Each of the ultrasonic transmission elements 56 transmits a spherical ultrasonic wave 55. In the ultrasonic transmission element group 57, the ultrasonic transmission elements 56 transmit the ultrasonic waves 55 with different phases for each row. Here, the ultrasonic wave 55 transmitted from the ultrasonic transmission element group 57 is transmitted in a direction diagonally intersecting the thickness direction of the transmission circuit substrate 51 and the X direction.

Figure 6:
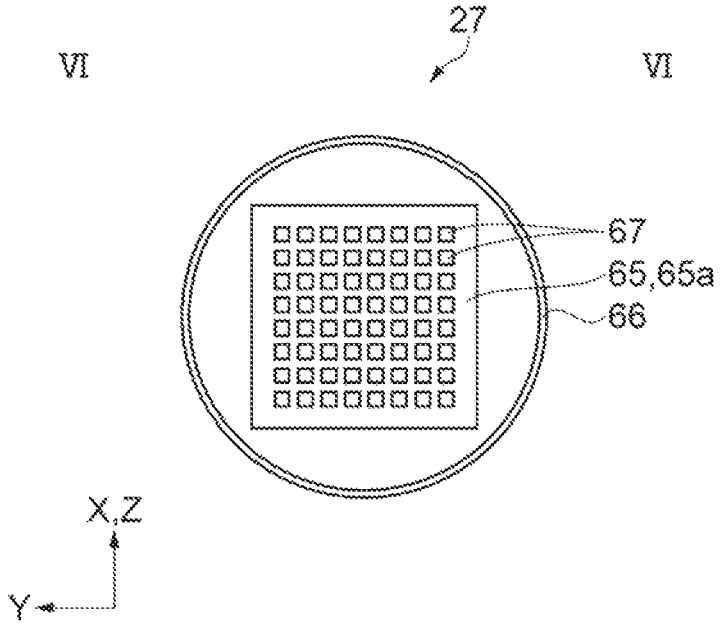
FIG. 6 is a schematic diagram for explaining a disposition of an ultrasonic receiving element in an ultrasonic receiver.

FIG. 6 is a schematic diagram for explaining a disposition of the ultrasonic receiving element in the ultrasonic receiver, and a diagram as seen from a side of a surface along line VI-VI of FIG. 4. As shown in FIG. 6, the ultrasonic receiving elements 67 are arranged in a matrix on the receiving element substrate 65. In the present embodiment, the ultrasonic receiving elements 67 of eight rows and eight columns are disposed on the receiving element substrate 65 in order to facilitate understanding of FIG. 6 and description. The number of ultrasonic receiving elements 67 installed on the receiving element substrate 65 is not particularly limited. For example, 100 ultrasonic receiving elements 67 of 10 rows and 10 columns may be disposed on the receiving element substrate 65.

Figure 7:
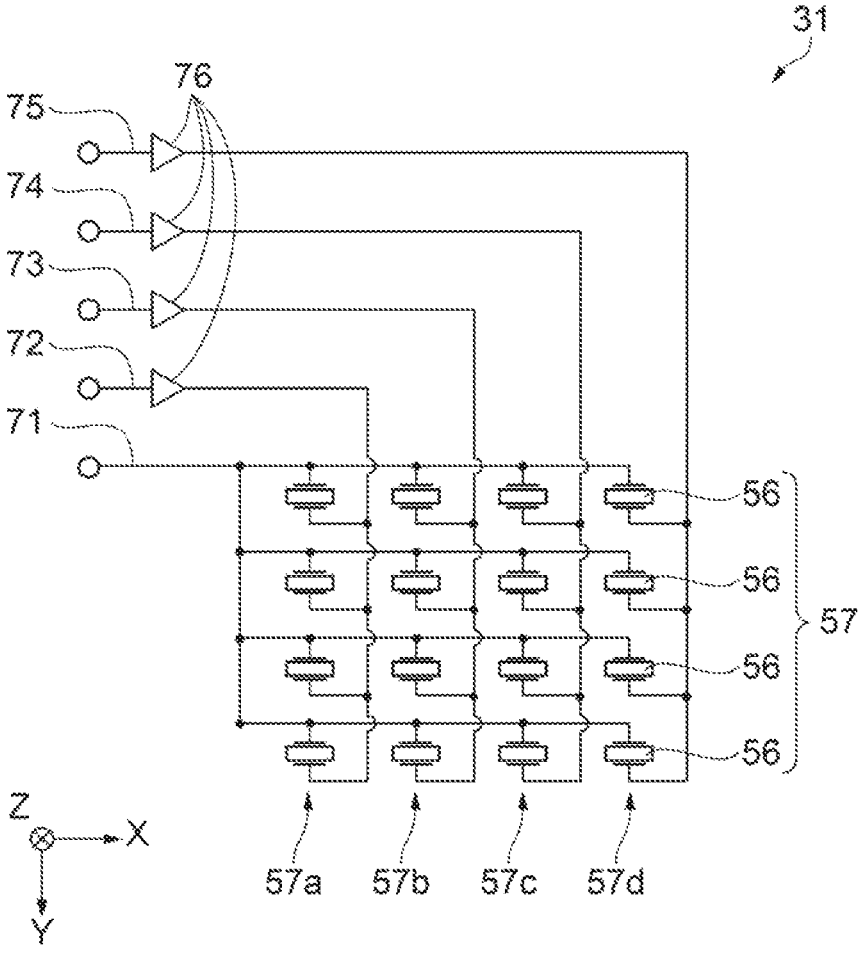
FIG. 7 is an electric circuit diagram of the ultrasonic transmitter.

FIG. 7 is an electric circuit diagram of the ultrasonic transmitter. As shown in FIG. 7, the ultrasonic transmission elements 56 arranged in a matrix have two electrodes. One of the electrodes is electrically connected to a common wiring 71. The other electrode is electrically connected to a different wiring for each column. The electrodes of the ultrasonic transmission elements 56 of the first column 57*a* are electrically connected to a first wiring 72. Similarly, the electrodes of the ultrasonic transmission elements 56 of the second column 57*b* are electrically connected to a second wiring 73. The electrodes of the ultrasonic transmission elements 56 of the third column 57*c* are electrically connected to a third wiring 74. The electrodes of the ultrasonic transmission elements 56 of the fourth column 57*d* are electrically connected to a fourth wiring 75.

The first wiring 72 to the fourth wiring 75 are provided with amplifying elements 76 in the middle of the wiring. The amplifying element 76 amplifies the power of the drive waveform for driving the ultrasonic transmission element 56. The drive waveform output from the amplifying element 76 drives the ultrasonic transmission element 56. The ultrasonic transmission element group 57 is electrically connected to the same wiring for each column. Since the ultrasonic transmission elements 56 are driven with the same drive waveform for each column, the ultrasonic transmission elements 56 in each column transmit ultrasonic waves 55 with the same phase.

Figure 8:
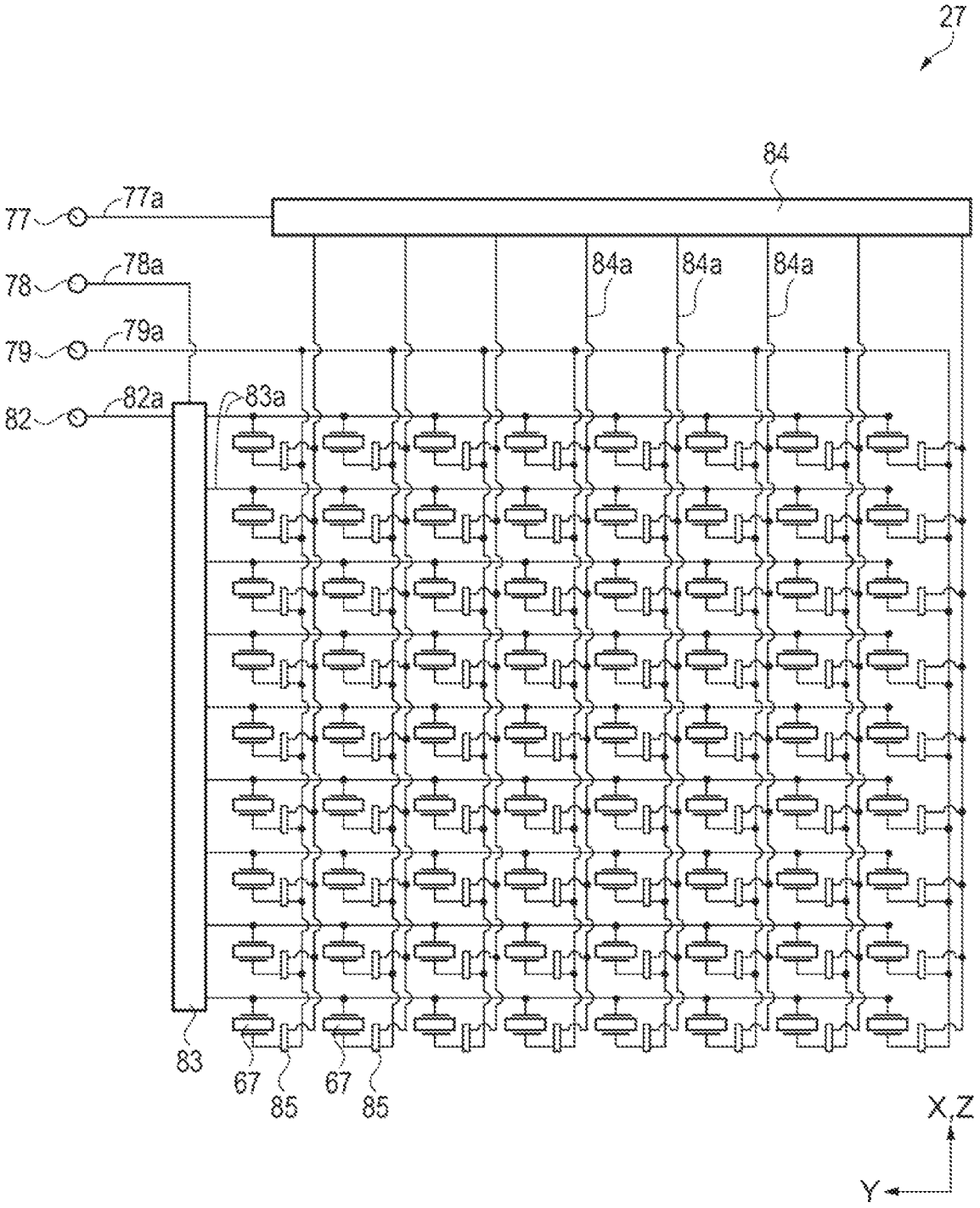
FIG. 8 is an electric circuit diagram of the ultrasonic receiver.

FIG. 8 is an electric circuit diagram of the ultrasonic receiver. As shown in FIG. 8, the ultrasonic receiver 27 includes a first terminal 77, a second terminal 78, a third terminal 79, and a fourth terminal 82. The first terminal 77 to the fourth terminal 82 are electrically connected to the receiving drive circuit 63 via the receiving element wiring 68 and the wiring 62*a*. The ultrasonic receiver 27 also includes a row wiring switching unit 83 and a column wiring switching unit 84. The first terminal 77 is electrically connected to the column wiring switching unit 84 by a first wiring 77*a*. The second terminal is electrically connected to the row wiring switching unit 83 by a second wiring 78*a*. The fourth terminal 82 is electrically connected to the row wiring switching unit 83 by a fourth wiring 82*a*.

The ultrasonic receiver 27 includes a plurality of ultrasonic receiving elements 67 and switching elements 85, and the ultrasonic receiving elements 67 and the switching elements 85 are arranged in a matrix. The switching elements 85 are switching elements composed of transistors. The ultrasonic receiving elements 67 have two electrodes. One of the electrodes is electrically connected to a row signal wiring 83*a*. Each of the ultrasonic receiving elements 67 is electrically connected to the row wiring switching unit 83 via the row signal wiring 83*a*.

The other electrode of each of the ultrasonic receiving elements 67 is connected to one switching element 85. Each of the switching elements 85 is electrically connected to the third terminal 79 by a column signal wiring 79*a*. Each of the switching elements 85 is electrically connected to the column wiring switching unit 84 by a column control wiring 84*a*.

The row wiring switching unit 83 receives a row control signal from the second terminal 78. The row wiring switching unit 83 electrically connects the fourth terminal 82 to one of the row signal wirings 83*a* of each row according to the row control signal. That is, the row wiring switching unit 83 selects the row of the ultrasonic receiving elements 67 to be driven.

The column wiring switching unit 84 receives a column control signal from the first terminal 77. The column wiring switching unit 84 short-circuits the switching elements 85 according to the column control signal. Accordingly, the column wiring switching unit 84 and the switching elements 85 electrically connect the ultrasonic receiving elements 67 of one column among a plurality of columns of the ultrasonic receiving elements 67 to the third terminal 79. That is, the column wiring switching unit 84 selects the column of the ultrasonic receiving elements 67 to be driven. The ultrasonic receiver 27 receives the row control signal and the column control signal and outputs the voltage waveform of the ultrasonic signal output from the ultrasonic receiving elements 67 at the position designated by the row control signal and the column control signal to the third terminal 79 and the fourth terminal 82.

Figure 9:
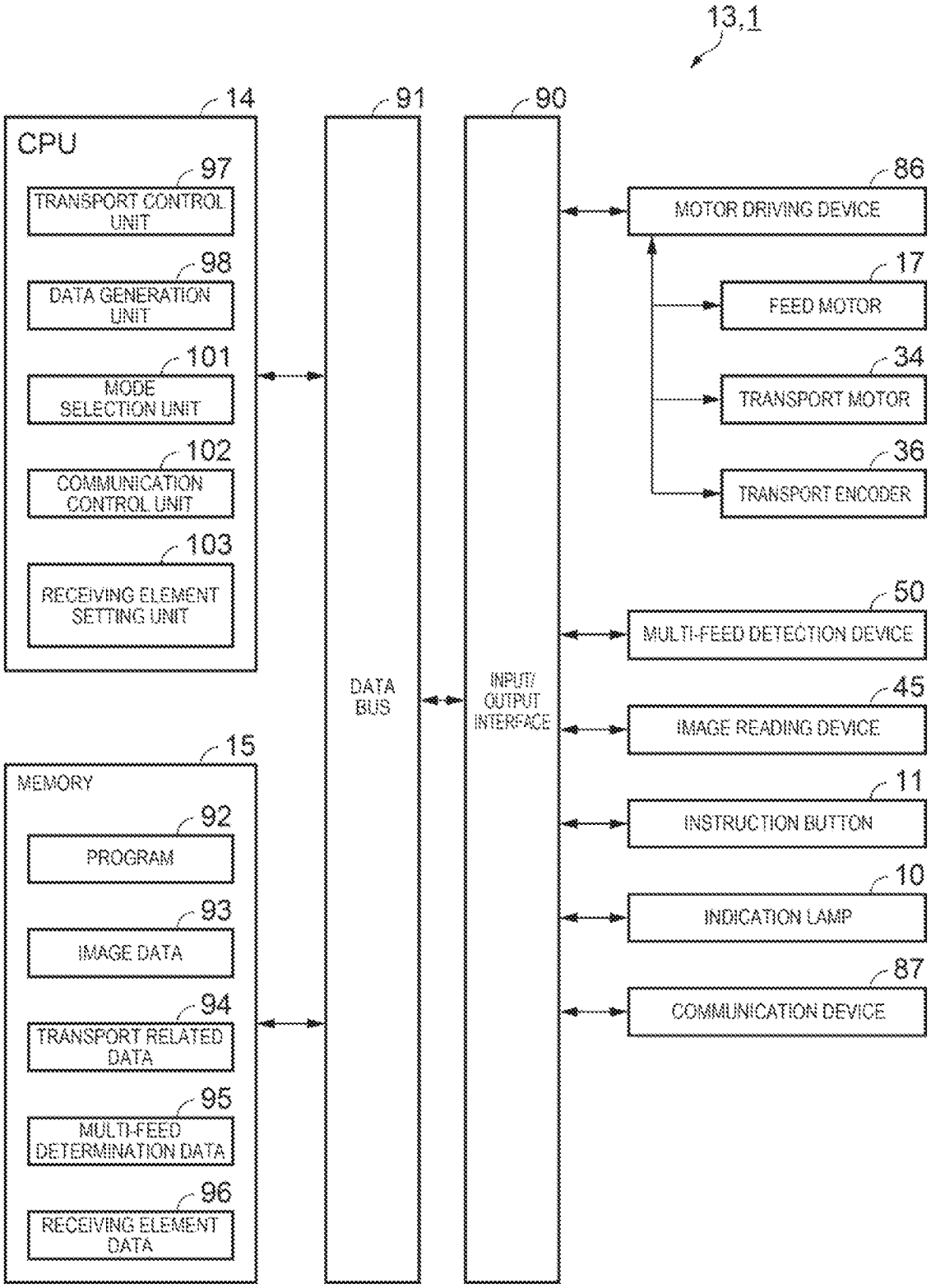
FIG. 9 is an electrical block diagram showing a configuration of a control unit.

FIG. 9 is an electrical block diagram showing a configuration of a control unit. In FIG. 9, the control unit 13 includes the CPU 14 (central processing unit) for performing various arithmetic processing as a processor and the memory 15 for storing various information. A motor driving device 86, the multi-feed detection device 50, the image reading device 45, the instruction button 11, the indication lamp 10, and a communication device 87 are connected to the CPU 14 via an input/output interface 90 and a data bus 91.

The motor driving device 86 is a circuit for driving the feed motor 17, the transport motor 34, and the transport encoder 36. The motor driving device 86 receives an instruction signal of the CPU 14. The motor driving device 86 rotates the feed motor 17 and the transport motor at a predetermined rotation angle at a predetermined rotation speed according to the instruction signal. The paper 6 is moved by the rotation of the feed motor 17 and the transport motor 34.

The motor driving device 86 converts the signal output from the transport encoder 36 into a digital data and outputs the digital signal to the CPU 14. Since the transport encoder 36 detects a moving amount of the paper 6, the CPU 14 receives the signal output from the motor driving device 86 and recognizes the position of the paper 6.

The multi-feed detection device 50 is a device installed in the transport path 39 of the paper 6 and a device which detects whether or not two or more sheets of paper 6 are overlapped. The multi-feed detection device 50 compares the intensity of the ultrasonic wave 55 the ultrasonic receiver 27 received with a determination value to detect the multi-feed of the paper 6. The multi-feed detection device 50 outputs information indicating a multi-feed state to the CPU 14 when two or more sheets of paper 6 are transported in the transport path 39 in an overlapped manner.

The image reading device 45 is a device which reads images on front and back surfaces of the paper 6. The image reading device 45 controls the lower reading unit 42 and the upper reading unit 44 while transporting the paper 6, and reads an image on the paper 6. Specifically, the image reading device 45 outputs a pulse signal for controlling the operation timing of a reading operation of a pixel signal with respect to the contact image sensor module and the like and controls the reading operation. The analog pixel signal output from the contact image sensor module is converted into digital image data and is stored in the memory 15. The image data includes information on the density of pixels constituting the image.

The instruction button 11 includes a plurality of switches and output information indicating the switch operated by the operator to the CPU 14. The indication lamp 10 includes a plurality of light sources. The indication lamp 10 receives the instruction signal of the CPU 14. Then, the light source corresponding to the instruction signal is turned on, blinked, or turned off.

The communication device 87 is a device which communicates with an external device. The communication device 87 communicates with the external device and outputs data of the image information read from the paper 6 to the external device according to a communication protocol. The communication device 87 receives various data and a reading start signal used at the time of reading an image from an external device.

The memory 15 is a concept including a semiconductor memory such as RAM, and ROM, and an external storage device such as a hard disk. The memory 15 stores a program 92 on which a control procedure of the operation of the scanner 1 and the like are written. The memory 15 stores image data 93 which is data of an image read by the image reading device 45. The memory 15 stores transport related data 94 which is data of various parameters used when the CPU 14 transports the paper 6. The memory 15 stores multi-feed determination data 95 which is data such as a determination value used when the multi-feed detection device 50 determines whether or not the paper is in a multi-feed state. The memory 15 stores receiving element data 96 which is data such as the number of ultrasonic receiving elements 67 that the ultrasonic receiver 27 receives the ultrasonic wave 55. The memory 15 includes a storage area functioning as a work area for the CPU 14, a temporary file, or the like, and other various storage areas.

The CPU 14 controls the operation of the scanner 1 according to the program 92 stored in the memory 15. The CPU 14 has various functional units for realizing functions. The CPU 14 has a transport control unit 97 as a specific functional unit. The transport control unit 97 controls a moving speed, the moving amount, a moving position, and the like of the paper 6. The transport control unit 97 outputs a parameter for controlling the transport of the paper 6 to the motor driving device 86. The transport control unit 97 outputs an instruction signal for starting and stopping the transport of the paper 6 to the motor driving device 86. The motor driving device 86 transports the paper 6 to the feed roller 21, the pair of transport rollers 38, and the pair of discharge rollers 49 according to the instruction signal output from the transport control unit 97.

The CPU 14 has a data generation unit 98. The data generation unit 98 performs correction processing such as shading correction and gamma correction with respect to the received digital image data 93, and generates the image data 93 for the output of paper 6.

The CPU 14 has a mode selection unit 101. The instruction button 11 includes one multi-feed detection switching switch. The mode selection unit 101 sets, for example, either an enable mode which enables multi-feed detection or a disable mode which disables the multi-feed detection of the multi-feed detection device 50 according to the instruction from the multi-feed detection switching switch.

The CPU 14 has a communication control unit 102. The communication control unit 102 communicates with an external device via the communication device 87. The communication control unit 102 receives an instruction signal from an external device and starts an operation such as reading. The communication control unit 102 converts the image data 93 into a data format to be communicated, and outputs the converted data to the communication device 87. The image data 93 is transmitted to the external device via the communication device 87.

The CPU 14 has a receiving element setting unit 103. The receiving element setting unit 103 checks the intensity of the ultrasonic wave 55 received by the arrayed ultrasonic receiving elements 67. The receiving element setting unit 103 specifies and sets the ultrasonic receiving element 67 suitable for receiving the ultrasonic wave 55 among the arrayed ultrasonic receiving elements 67.

The CPU 14 has a functional unit (not shown). For example, the CPU 14 performs control to display information related to device status display or reading on the indication lamp 10. The CPU 14 performs control to notify abnormality with the indication lamp 10 when the abnormality occurs in the scanner 1.

Figure 10:
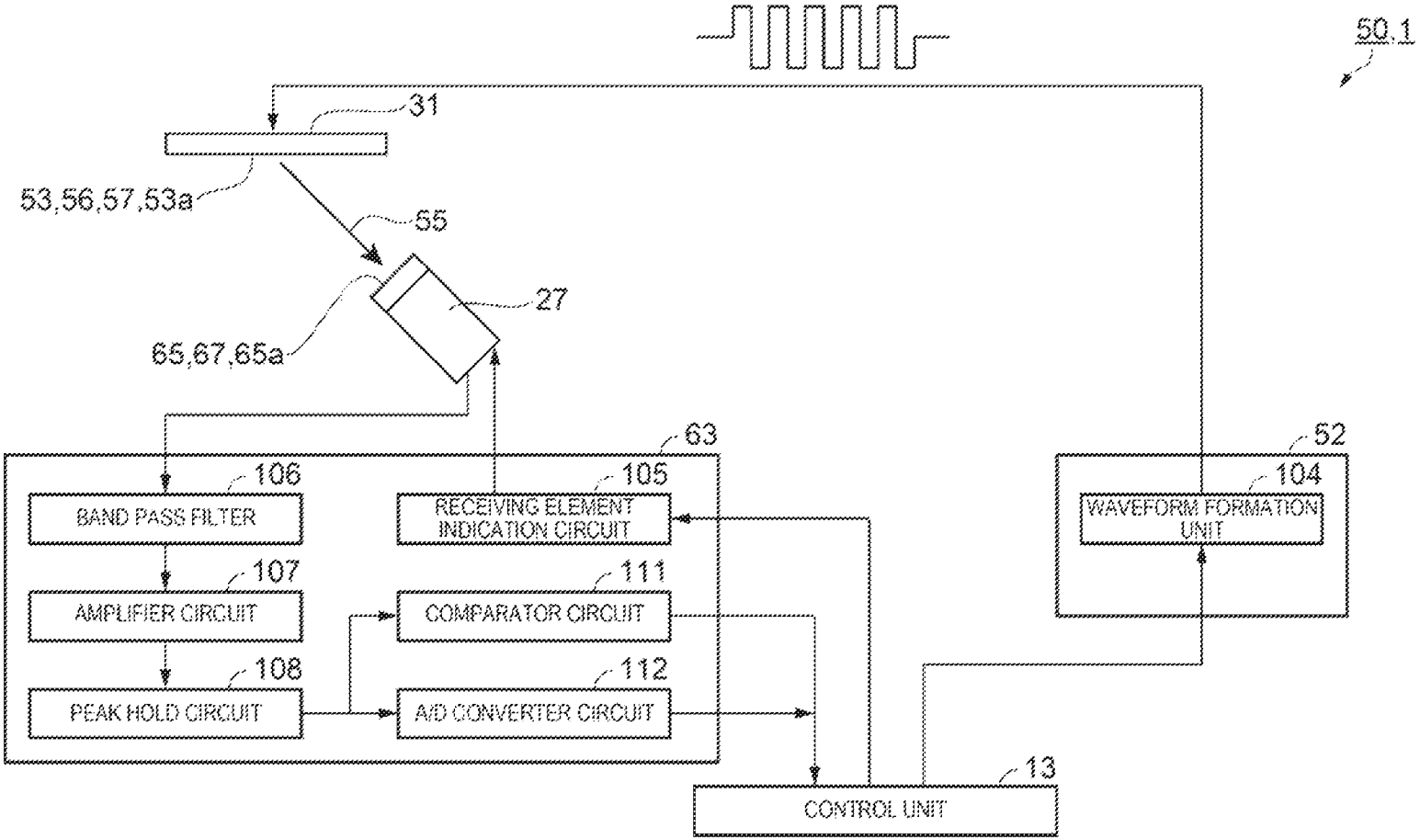
FIG. 10 is an electrical block diagram showing a configuration of the multi-feed detection device.

FIG. 10 is an electrical block diagram showing a configuration of the multi-feed detection device. As shown in FIG. 10, the transmission drive circuit 52 is electrically connected to the control unit 13. The transmission drive circuit 52 includes a waveform formation unit 104. In the transmission drive circuit 52, the waveform formation unit 104 forms a drive waveform for driving and outputs the waveform to the ultrasonic transmission element 56. The drive waveform is a waveform matching the characteristics of the ultrasonic transmission elements 56, and is not particularly limited. In the present embodiment, the drive waveform is, for example, a burst wave having a voltage amplitude of 24 V and a frequency of 300 KHz. The ultrasonic transmission element group 57 including 16 ultrasonic transmission elements 56 receives the drive waveform and transmits the ultrasonic wave 55. The drive waveform is a waveform for driving the ultrasonic transmission element 56. The multi-feed detection device 50 includes the transmission drive circuit 52 for driving the ultrasonic transmission element 56.

The receiving drive circuit 63 includes a receiving element indication circuit 105. In the control unit 13, the receiving element setting unit 103 outputs the data indicating the number of ultrasonic receiving element 67 to be driven to the receiving element indication circuit 105. The receiving element indication circuit 105 stores the number of ultrasonic receiving element 67 to be driven and outputs a signal indicating the row number of ultrasonic receiving element 67 to be driven to the row wiring switching unit 83 of the ultrasonic receiver 27. The receiving element indication circuit 105 outputs a signal indicating a column number of ultrasonic receiving elements 67 to be driven to the column wiring switching unit 84.

The ultrasonic receiving element 67 installed on the receiving surface 65*a* of the receiving element substrate 65 receives the ultrasonic wave 55 and outputs the voltage waveform to the receiving drive circuit 63. Here, the ultrasonic receiver 27 outputs the voltage waveform of an ultrasonic signal output by the ultrasonic receiving element 67 of the indicated row number and column number to the receiving drive circuit 63.

The receiving drive circuit 63 includes a band pass filter 106, and the band pass filter 106 receives the voltage waveform from the ultrasonic receiving element 67. The center frequency of the band pass filter 106 is 300 KHz, and the band pass filter 106 has a function of removing noise components other than the waveform corresponding to the ultrasonic wave 55 from the voltage waveform.

An amplifier circuit 107 is disposed in electrical connection with the band pass filter 106. The amplifier circuit 107 amplifies the voltage waveform received from the band pass filter 106 to substantially 10,000 times. As the amplifier circuit 107 amplifies the voltage waveform, the influence of noise can be reduced and the voltage waveform can be easily operated. A peak hold circuit 108 is disposed in electrical connection with the amplifier circuit 107. The peak hold circuit 108 detects the maximum amplitude of the burst signal of the voltage waveform.

A comparator circuit 111 and an analog-to-digital converter 112 (A/D converter circuit) are disposed in electrical connection with the peak hold circuit 108. The comparator circuit 111 compares the multi-feed determination data 95 stored in the memory 15 with the maximum amplitude of the burst signal. Then, the determination result is output to the control unit 13. When the multi-feed is occurring, the CPU 14 notifies the operator that multi-feed has occurred by blinking one indication lamp 10.

The A/D converter circuit 112 converts the maximum amplitude of the burst signal into digital data. The maximum amplitude of the burst signal converted into digital data is output to the CPU 14 as one of the receiving element data 96. The maximum amplitude of the burst signal changes when the medium transported through the transport path 39 is changed from the paper 6. The operator can reset the multi-feed determination data 95 of the predetermined medium to the comparator circuit 111 with reference to the maximum amplitude of the burst signal. Accordingly, the multi-feed detection device 50 can determine multi-feed even when the paper 6 is replaced with another medium.

Next, the drive waveform output from the waveform formation unit 104 to the ultrasonic transmission element group 57 of the ultrasonic transmitter 31 will be described. FIGS. 11A to 11D are time charts indicating the drive waveforms for driving the ultrasonic transmission element group. In FIGS. 11A to 11D, the vertical axis shows the drive voltage and the drive voltage is higher on the upper side than the lower side in FIGS. 11A to 11D. The horizontal axis shows time transition, and the time changes from the left side to the right side in FIGS. 11A to 11D.

Figure 11A:
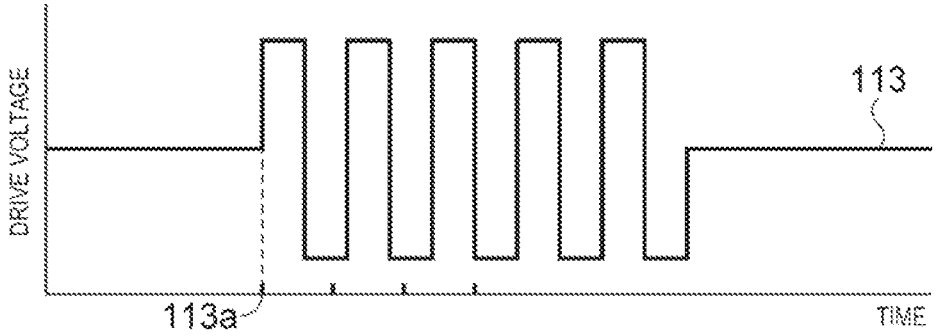
FIG. 11A is a time chart showing a drive waveform for driving an ultrasonic transmission element group.
Figure 11B:
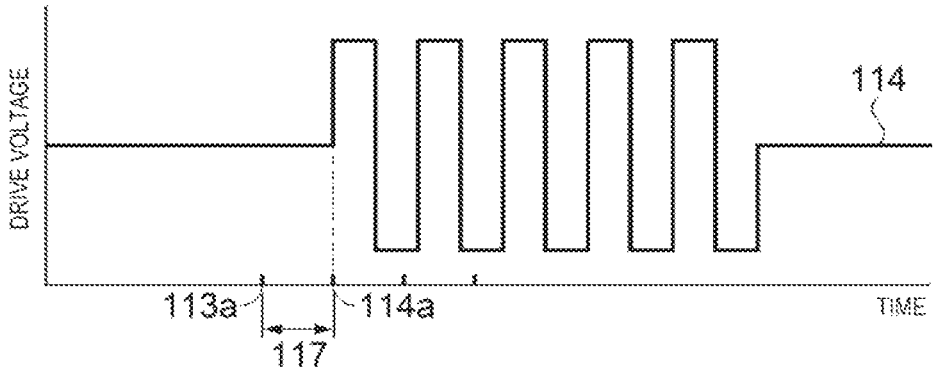
FIG. 11B is a time chart showing a drive waveform for driving an ultrasonic transmission element group.
Figure 11C:
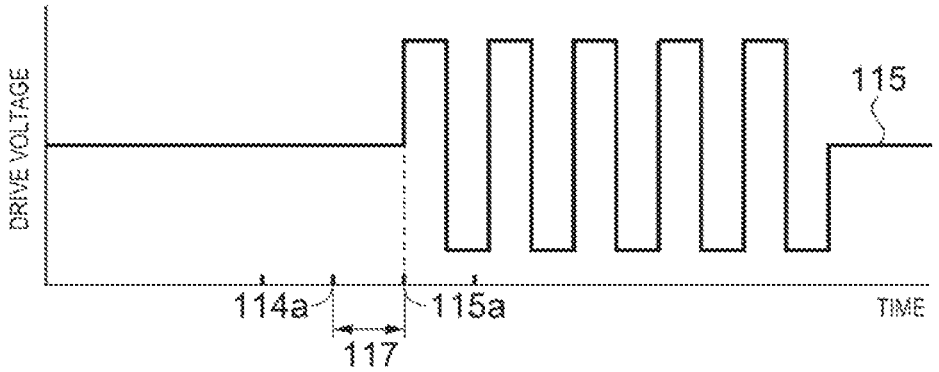
FIG. 11C is a time chart showing a drive waveform for driving an ultrasonic transmission element group.
Figure 11D:
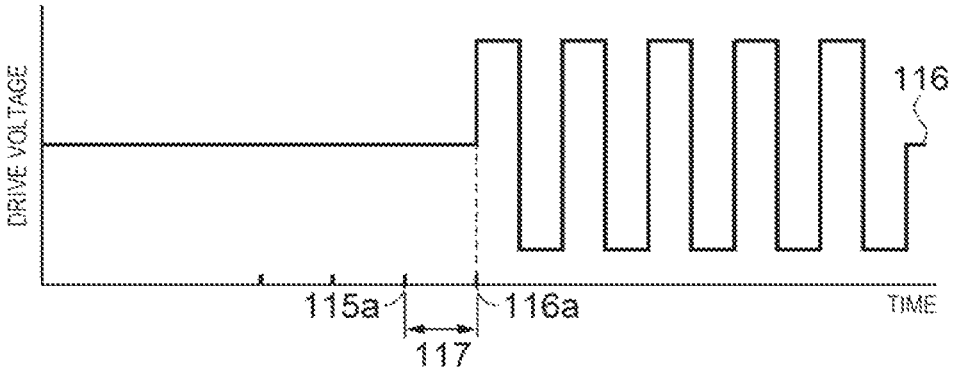
FIG. 11D is a time chart showing a drive waveform for driving an ultrasonic transmission element group.

A first drive waveform 113 shown in FIG. 11A is a drive waveform for driving the ultrasonic transmission elements 56 of the first column 57*a*. A second drive waveform 114 shown in FIG. 11B is a drive waveform for driving the ultrasonic transmission elements 56 of the second column 57*b*. A third drive waveform 115 shown in FIG. 11C is a drive waveform for driving the ultrasonic transmission elements 56 of the third column 57*c*. A fourth drive waveform 116 shown in FIG. 11D is a drive waveform for driving the ultrasonic transmission elements 56 of the fourth column 57*d*.

The first drive waveform 113 to the fourth drive waveform 116 have the same waveform shape. The waveform shapes of the first drive waveform 113 to the fourth drive waveform 116 are not particularly limited and may be any shape as long as it is suitable for driving of the ultrasonic transmission elements 56. In the present embodiment, for example, the waveform shapes of the first drive waveform 113 to the fourth drive waveform 116 are burst signals configured of five rectangular waves.

The first drive waveform 113 rises from a first time 113*a*. The second drive waveform 114 rises from a second time 114*a* after a lapse of delay time 117 from the first time 113*a*. The third drive waveform 115 rises from a third time 115*a* after a lapse of the delay time 117 from the second time 114*a*. The fourth drive waveform 116 rises from a fourth time 116*a* after a lapse of the delay time 117 from the third time 115*a*. In this way, the first drive waveform 113 to the fourth drive waveform 116 have waveforms that rise at the same waveform and have different rising times. By changing the rising time of the drive waveform, the phase of the ultrasonic wave 55 transmitted by each of the ultrasonic transmission elements 56 changes. The transmission drive circuit 52 controls the phase of the ultrasonic wave 55 transmitted by each of the ultrasonic transmission elements 56.

Figure 12:
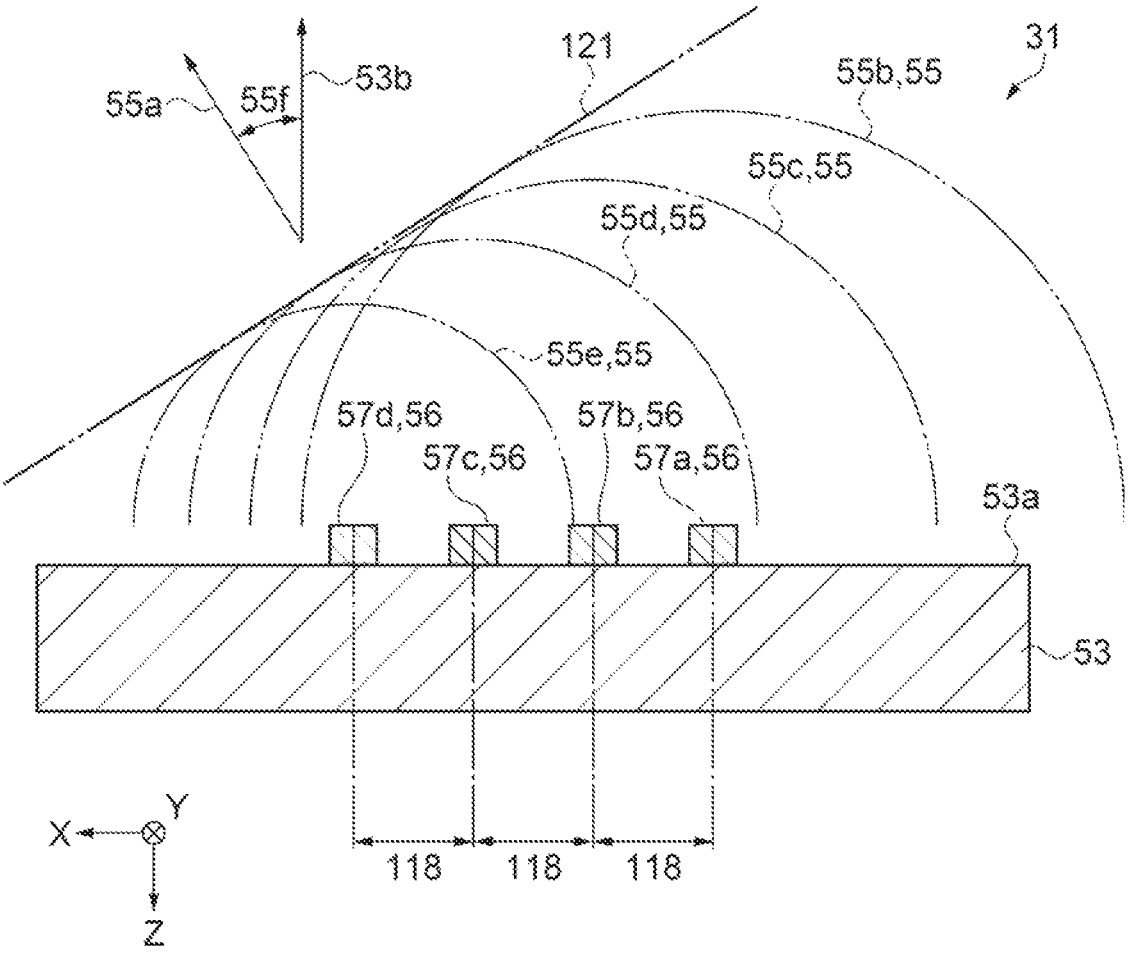
FIG. 12 is a schematic diagram for explaining the ultrasonic wave transmitted from the ultrasonic transmitter.

FIG. 12 is a schematic diagram for explaining the ultrasonic wave transmitted from the ultrasonic transmitter. As shown in FIG. 12, in the ultrasonic transmitter 31, the first column 57*a*, the second column 57*b*, the third column 57*c*, and the fourth column 57*d* of the ultrasonic transmission elements 56 are arranged at equal interval on the transmission element substrate 53. The distance between each column is referred to as an interelement distance 118.

After the ultrasonic transmission elements 56 of the first column 57*a* transmit the ultrasonic wave 55 to the first time 113*a*, the ultrasonic transmission elements 56 of the second column 57*b* transmit the ultrasonic wave 55 at the second time 114*a* after a lapse of the delay time 117. After the ultrasonic transmission elements 56 of the second column 57*b* transmit the ultrasonic wave 55 to the second time 114*a*, the ultrasonic transmission elements 56 of the third column 57*c* transmit the ultrasonic wave 55 at the third time 115*a* after a lapse of the delay time 117. After the ultrasonic transmission elements 56 of the third column 57*c* transmit the ultrasonic wave 55 to the third time 115*a*, the ultrasonic transmission elements 56 of the fourth column 57*d* transmit the ultrasonic wave 55 at the fourth time 116*a* after a lapse of the delay time 117.

The ultrasonic wave 55 transmitted by the ultrasonic transmission elements 56 of the first column 57*a* is referred to as a first ultrasonic wave 55*b*. Similarly, the ultrasonic waves 55 transmitted by the ultrasonic transmission elements 56 of the second column 57*b*, the third column 57*c*, and the fourth column 57*d* are respectively referred to as a second ultrasonic wave 55*c*, a third ultrasonic wave 55*d*, and a fourth ultrasonic wave 55*e*.

The ultrasonic wave 55 in FIG. 12 shows a state after the lapse of a predetermined time from the transmission of the fourth ultrasonic wave 55*e*. Here, the first ultrasonic wave 55*b* is most distant from the ultrasonic transmission elements 56 of the first column 57*a*. Next, the second ultrasonic wave 55*c* is most distant from the ultrasonic transmission elements 56 of the second column 57*b*. Next, the third ultrasonic wave 55*d* is most distant from the ultrasonic transmission elements 56 of the third column 57*c*. Next, the fourth ultrasonic wave 55*e* is most distant from the ultrasonic transmission elements 56 of the fourth column 57*d*.

The first ultrasonic wave 55*b* to the fourth ultrasonic wave 55*e* have a common tangent line 121. The tangent line 121 from the first ultrasonic wave 55*b* to the fourth ultrasonic wave 55*e* has a high intensity of the ultrasonic wave 55. Since the tangent line 121 has a predetermined width in the Y direction, the tangent line 121 becomes a wave surface. The advancing direction of the tangent line 121 becomes an advancing direction 55*a* of the ultrasonic wave. The thickness direction of the transmission element substrate 53 is referred to as a substrate thickness direction 53*b*. The substrate thickness direction 53*b* is a direction in the −Z direction orthogonal to the transmission surface 53*a*.

The angle between the substrate thickness direction 53*b* and the advancing direction 55*a* of the ultrasonic wave is referred to as an advance angle 55*f* of the ultrasonic wave. $\theta=\arcsin(V\times\Delta T/d)$ where d=interelement distance 118, V=advancing speed of ultrasonic wave 55, $\Delta T$=delay time 117, and $\theta$=advance angle 55*f*. In this equation, the interelement distance 118 is a predetermined distance and does not change. The advancing speed of the ultrasonic wave 55 also does not change unless the environment changes. By controlling the delay time 117 by the transmission drive circuit 52, the advance angle 55*f* of the ultrasonic wave can be controlled.

The transmission drive circuit 52 controls the phase of the ultrasonic wave 55 transmitted by each of the ultrasonic transmission elements 56 to control the advancing direction of the ultrasonic wave 55. By increasing the phase difference of the ultrasonic wave 55 transmitted by each of the ultrasonic transmission elements 56, the advance angle 55*f* of the ultrasonic wave in which the advancing direction 55*a* of the ultrasonic wave intersects the substrate thickness direction 53*b* can be increased. The transmission drive circuit 52 can control the advancing direction of the ultrasonic wave 55 so that the ultrasonic wave 55 advances toward the ultrasonic receiver 27.

Figure 13:
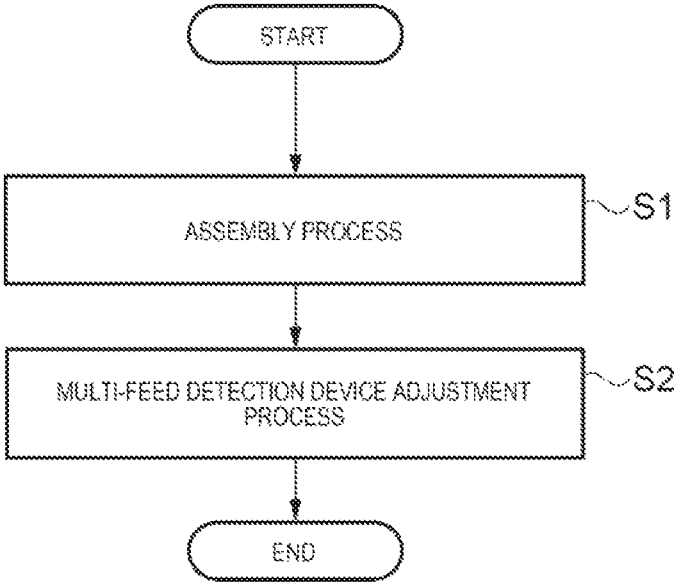
FIG. 13 is a flowchart of an assembly adjustment method.

Next, the assembly adjustment method and multi-feed detection method of the above-described scanner 1 will be described with reference to FIGS. 13 to 18. FIG. 13 is a flowchart of the assembly adjustment method. FIGS. 14 to 18 are diagrams for explaining the assembly adjustment method. In the flowchart of FIG. 13, step S1 is an assembly process. This process is a process of assembling the scanner 1. Next, the procedure proceeds to step S2. Step S2 is a multi-feed detection device adjustment process. The method of performing step S2 is a part of the multi-feed detection method. This process is a process of adjusting the positional deviation of the multi-feed detection device 50. The assembly adjustment process is ended in the above steps. Multi-feed detection is performed after the assembly adjustment process.

Next, the assembly adjustment method will be described in detail in correspondence with steps shown in FIG. 13 using FIG. 2 and FIGS. 14 to 18.

Figure 14:
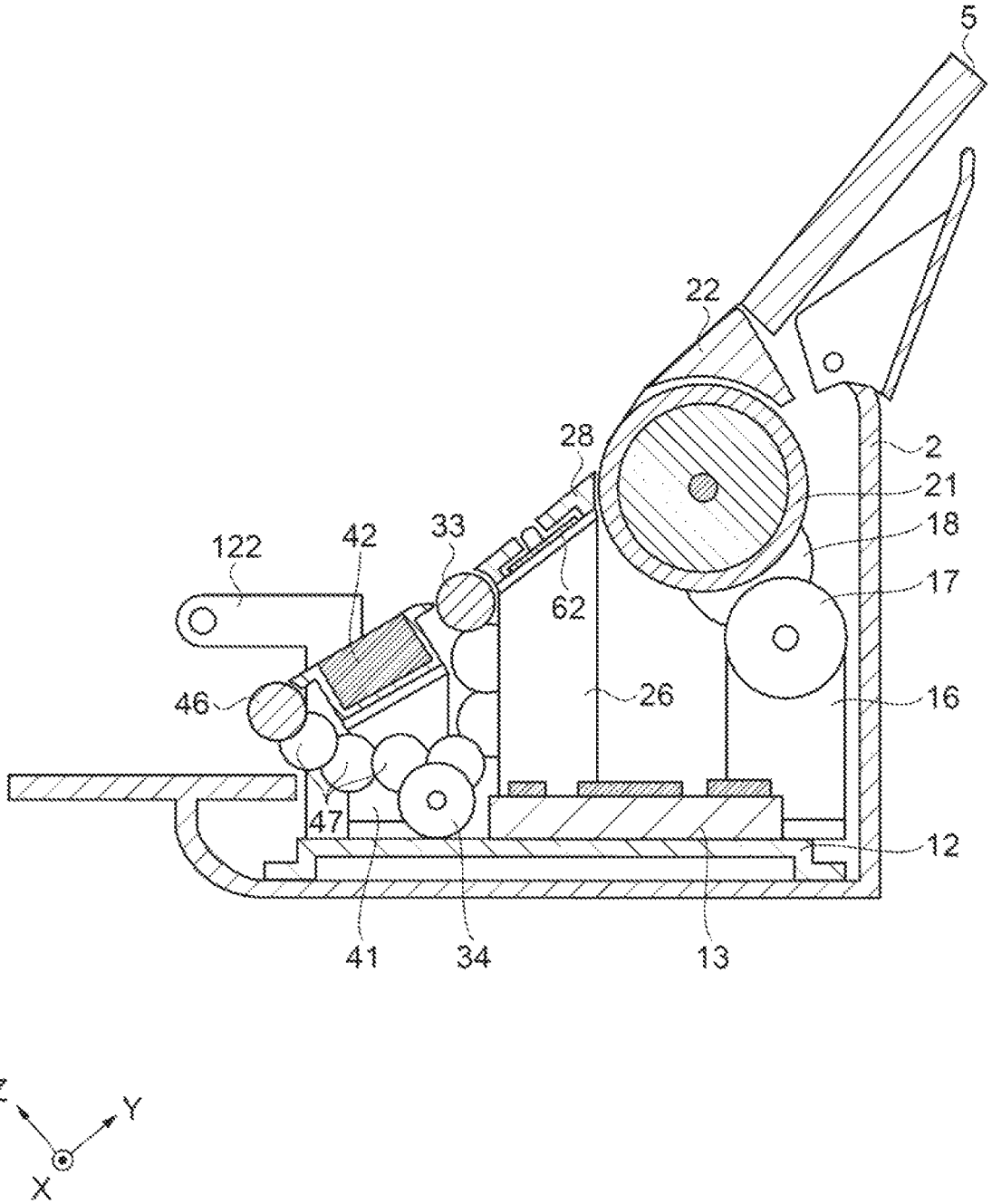
FIG. 14 is a schematic diagram for explaining the assembly adjustment method.
Figure 15:
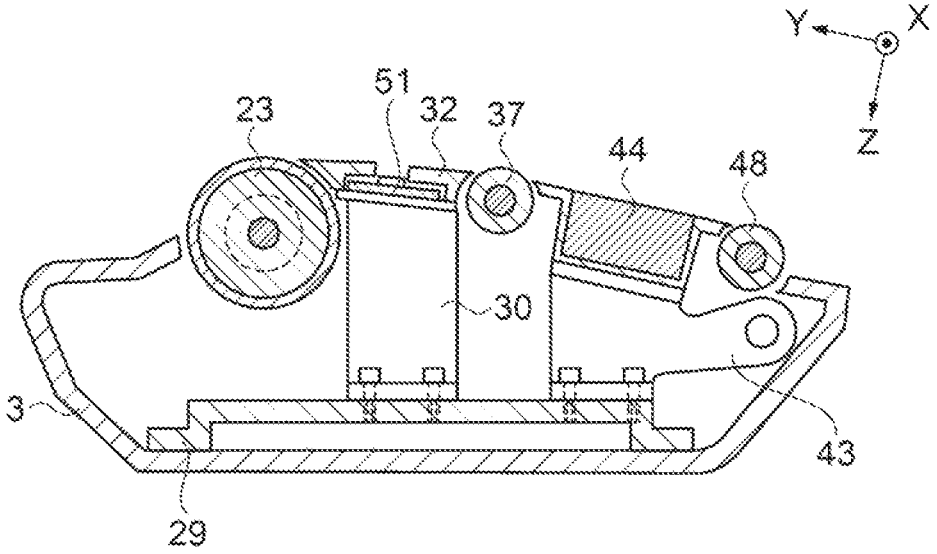
FIG. 15 is a schematic diagram for explaining the assembly adjustment method.

FIGS. 2, 14, and 15 are diagrams corresponding to the assembly process of step S1. As shown in FIG. 14, the lower substrate 12 is fixed on the bottom surface inside the lower case 2 with screws. Next, the transport motor 34 and the control unit 13 are fixed on the lower substrate 12 with screws.

Next, the lower reading unit 42 is fixed to the fourth support portion 41 with screws. Then, the fourth support portion 41 is fixed to the lower substrate 12 with screws. Next, the receiving circuit substrate 62 and the midstream lower guide portion 28 are fixed to the second support portion 26 with screws. Then, the second support portion 26 is fixed to the lower substrate 12 with screws. Next, the feed motor 17 is fixed to the first support portion 16 with screws. Then, the first support portion 16 is fixed to the lower substrate 12 with screws. Next, a sixth support portion 122 supporting the hinge 4 is fixed to the lower substrate 12 with screws.

Next, a lower plate (not shown) is temporarily installed on the lower substrate 12. The lower plate is installed on the +X direction side and the −X direction side of the lower substrate 12. Bearings of the discharge drive roller 46, the third wheel train 47, the transport drive roller 33, the second wheel train 35, the first wheel train 18, and the feed roller 21 are installed on the lower plate. Next, the discharge drive roller 46, the third wheel train 47, the transport drive roller 33, the second wheel train 35, the first wheel train 18, and the feed roller 21 are installed on each bearing on the lower plate. Next, the lower plate is fixed to the lower substrate 12 with screws. Next, the cover portion 5, the upstream guide portion 22, and the like are installed on the lower case 2.

As shown in FIG. 15, the upper substrate 29 is fixed on the bottom surface inside the upper case 3 with screws. Next, the upper reading unit 44 is fixed to the fifth support portion 43 with screws. Then, the fifth support portion 43 is fixed to the upper substrate 29 with screws. Next, the transmission circuit substrate 51 and the midstream upper guide portion 32 are fixed to the third support portion 30 with screws. Then, the third support portion 30 is fixed to the upper substrate 29 with screws.

Next, an upper plate (not shown) is temporarily installed on the upper substrate 29. The upper plate is installed on the +X direction side and the −X direction side of the upper substrate 29. Bearings of the separation roller 23, the transport driven roller 37, and the discharge driven roller 48 are installed on the upper plate. Next, the separation roller 23, the transport driven roller 37, and the discharge driven roller 48 are installed on each bearing on the upper plate. Next, the upper plate is fixed to the upper substrate 29 with screws. Next, the fifth support portion 43 and the sixth support portion 122 are rotatably fixed to the hinge 4 with screws. As a result, the scanner 1 shown in FIG. 2 is assembled.

Figure 16:
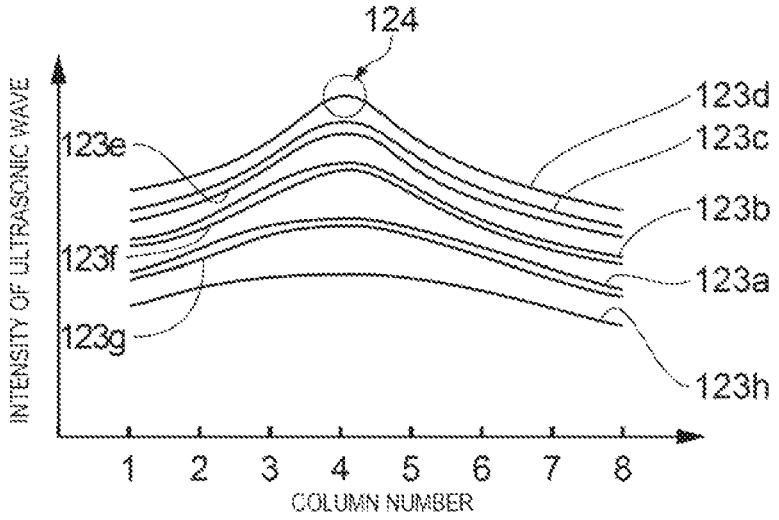
FIG. 16 is a graph for explaining the assembly adjustment method.
Figure 18:
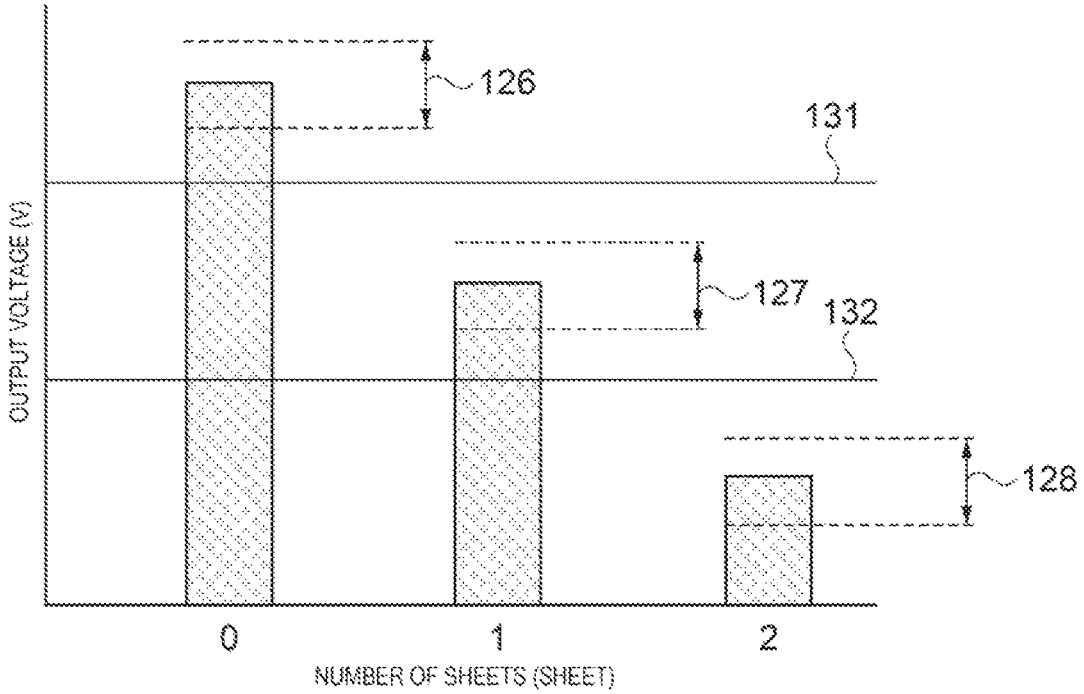
FIG. 18 is a graph for explaining the assembly adjustment method.

FIGS. 16 and 18 are diagrams corresponding to the multi-feed detection device adjustment process of step S2. In step S2, which is a part of the multi-feed detection method, the ultrasonic wave 55 is transmitted from the ultrasonic transmitter 31 toward the ultrasonic receiver 27. The intensity distribution of the ultrasonic wave 55 shows directivity in the advancing direction 55*a* of the ultrasonic wave.

The receiving element setting unit 103 selects the ultrasonic receiving element 67 which outputs the intensity of the ultrasonic wave 55. The receiving element setting unit 103 outputs the data indicating the number of ultrasonic receiving element 67 to be driven to the receiving element indication circuit 105. Specifically, the receiving element setting unit 103 designates the ultrasonic receiving elements 67 that output data indicating the intensity of the ultrasonic wave 55 in order from the first to eighth columns of the first row. Thereafter, the first to eighth columns are sequentially designated in the second to eighth rows. The receiving element setting unit 103 outputs data indicating the intensity of the ultrasonic wave 55 from all of the ultrasonic receiving elements 67 and stores the data in the memory 15 as the receiving element data 96.

FIG. 16 shows an example of the intensity distribution of the ultrasonic wave 55 received by each of the ultrasonic receiving elements 67 of the ultrasonic receiver 27. The intensity distribution of the ultrasonic wave 55 is a distribution depending on the relative position between the ultrasonic transmitter 31 and the ultrasonic receiver 27. Then, in the ultrasonic receiver 27, the plurality of ultrasonic receiving elements 67 receive the ultrasonic waves 55. A first row distribution 123*a* to an eighth row distribution 123*h* show an example of the receiving element data 96.

The vertical axis in FIG. 16 indicates the intensity of the ultrasonic waves 55 received by the ultrasonic receiving elements 67. The horizontal axis indicates the column number of ultrasonic receiving elements 67. In FIG. 6, the column numbers are set in order from the first column to the eighth column from +Y side to −Y side. The row numbers are set in order from the first row to the eighth row from +X side to −X side.

Returning to FIG. 16, the first row distribution 123*a* is the intensity distribution of the ultrasonic wave 55 received by the ultrasonic receiving elements 67 in the first row. Similarly, the second row distribution 123*b* to the eighth row distribution 123*h* are the intensity distributions of the ultrasonic waves 55 received by the ultrasonic receiving elements 67 in the second row to the eighth row, respectively. Among the first row distribution 123*a* to the eighth row distribution 123*h*, the fourth row distribution 123*d* is the distribution with the strongest intensity of the ultrasonic wave 55. In the fourth row distribution 123*d*, there is a peak 124 in the fourth column among the first to eighth columns. In the ultrasonic receiver 27, the ultrasonic receiving element 67 in the fourth row and the fourth column is receiving the ultrasonic wave 55 with the highest sensitivity. The receiving element setting unit 103 analyzes the first row distribution 123*a* to the eighth row distribution 123*h* and specifies the ultrasonic receiving element 67 which can receive the ultrasonic wave 55 with high sensitivity. That is, in the ultrasonic receiver 27, the plurality of ultrasonic receiving elements 67 receive the ultrasonic wave 55 and specifies the optimum ultrasonic receiving element which is the ultrasonic receiving element 67 which received the ultrasonic wave 55 with the strongest intensity.

Figure 17:
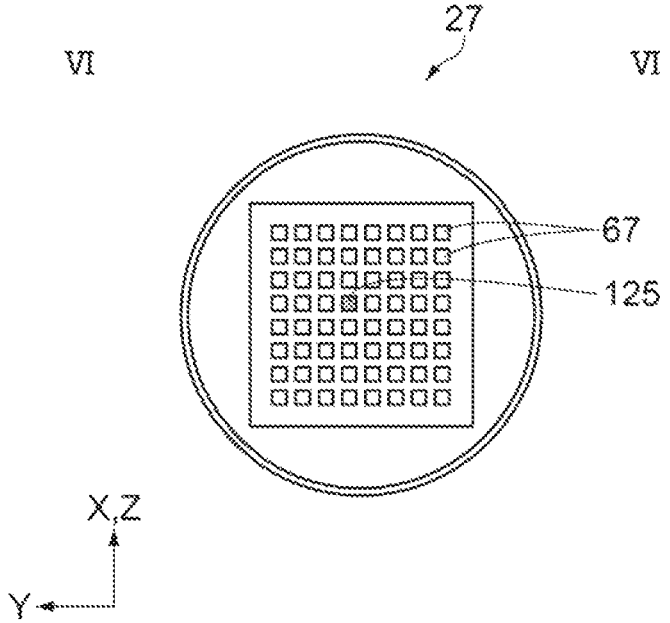
FIG. 17 is a schematic diagram for explaining the assembly adjustment method.

As shown in FIG. 17, the receiving element setting unit 103 sets the ultrasonic receiving element 67 in the fourth row and the fourth column which can receive the ultrasonic wave 55 with high sensitivity as an optimum ultrasonic receiving element 125 for receiving the ultrasonic wave 55 with the strongest intensity. An electrical signal corresponding to the intensity of the ultrasonic wave 55 is output from the set ultrasonic receiving element 67 to the receiving drive circuit 63. As described above, the plurality of ultrasonic receivers 27 receive the ultrasonic wave 55 transmitted from the ultrasonic transmitter 31, and the ultrasonic receiver 27 outputs an electrical signal corresponding to the intensity of the ultrasonic wave 55 from the optimum ultrasonic receiving element 125, which is the ultrasonic receiving element 67 which receives the ultrasonic wave 55 with the strongest intensity among the plurality of ultrasonic receiving elements 67.

Even when the relative position between the ultrasonic transmitter 31 and the ultrasonic receiver 27 varies when assembling the ultrasonic transmitter 31 and the ultrasonic receiver 27, it is possible to output an electrical signal corresponding to the ultrasonic wave 55 from the optimum ultrasonic receiving element 125 which receives the ultrasonic wave 55 with the highest intensity. As a result, it is possible to assemble the transmission circuit substrate 51 and the ultrasonic receiver 27 without requiring the positional accuracy of the relative position between the ultrasonic transmitter 31 and the ultrasonic receiver 27.

FIG. 18 is a graph for explaining the output voltage of the peak hold circuit in each number of paper 6. In FIG. 18, a vertical axis shows the output voltage of the peak hold circuit 108. A horizontal axis shows the number of paper 6 passing through the ultrasonic transmitter 31. When the number of paper 6 is zero, that is, when there is no paper 6 between the ultrasonic receiver 27 and the ultrasonic transmitter 31, the output voltage of the peak hold circuit 108 is high. When the number of paper 6 increases, the output voltage decreases.

A first setting range 126 which is a setting range of the output voltage when the number of paper 6 is zero is set. When the optimum ultrasonic receiving element 125 receives the ultrasonic wave 55 with the strongest intensity in the distribution of the ultrasonic waves 55 transmitted by the ultrasonic transmitter 31, the output voltage the peak hold circuit 108 is set to fall within the first setting range 126.

The transmission circuit substrate 51 and the ultrasonic receiver 27 are assembled such that the output voltage of the peak hold circuit 108 falls within the first setting range 126. The output voltage of the peak hold circuit 108 when the number of paper 6 is one falls below the first setting range 126 and falls within a first voltage range 127. The output voltage of the peak hold circuit 108 when the number of paper 6 is two falls below the first voltage range 127 and falls within a second voltage range 128.

The intermediate voltage between the lower limit voltage of the first setting range 126 and the upper limit voltage of the first voltage range 127 is referred to as a presence determination voltage 131. The comparator circuit 111 compares the output voltage of the peak hold circuit 108 with the presence determination voltage 131. When the output voltage of the peak hold circuit 108 is higher than the presence determination voltage 131, the comparator circuit 111 outputs a signal indicating that there is no paper 6 between the ultrasonic receiver 27 and the ultrasonic transmitter 31 to the control unit 13.

The intermediate voltage between the lower limit voltage of the first voltage range 127 and the upper limit voltage of the second voltage range 128 is referred to as a multi-feed determination voltage 132. The comparator circuit 111 compares the output voltage of the peak hold circuit 108 with the multi-feed determination voltage 132. When the output voltage of the peak hold circuit 108 is lower than the multi-feed determination voltage 132, the comparator circuit 111 outputs a signal indicating that there are two or more sheets of paper 6 between the ultrasonic receiver 27 and the ultrasonic transmitter 31 to the control unit 13.

As shown in FIG. 4, the ultrasonic transmitter 31 transmits the ultrasonic wave 55 to the sheet-like paper 6 passing between the ultrasonic transmitter 31 and the ultrasonic receiver 27. In the ultrasonic receiver 27, the optimum ultrasonic receiving element 125 receives the ultrasonic wave 55 passed through the paper 6. Next, the comparator circuit 111 detects the number of paper 6 from the intensity of the ultrasonic wave 55 received by the optimum ultrasonic receiving element 125.

The receiving element setting unit 103 sets the optimum ultrasonic receiving element 125 so that the output voltage of the peak hold circuit 108 falls within the first setting range 126, so that it is possible to easily detect whether the number of paper 6 between the transmission circuit substrate 51 and the ultrasonic receiver 27 is zero or two or more. The multi-feed detection device adjustment process of step S2 ends when the receiving element setting unit 103 sets the optimum ultrasonic receiving element 125 and the output voltage of the peak hold circuit 108 falls within the first setting range 126. In addition to step S2, the method by which the comparator circuit 111 detects the number of paper 6 using the intensity of the ultrasonic wave 55 received by the optimum ultrasonic receiving element 125 and the multi-feed determination voltage 132 is the multi-feed detection method.

As described above, according to the present embodiment, it has the following effects.

(1) According to the present embodiment, the multi-feed detection device 50 includes the transmission circuit substrate 51 on which the ultrasonic transmitter 31 is installed and the ultrasonic receiver 27. The ultrasonic receiver 27 receives the ultrasonic wave 55 transmitted from the ultrasonic transmitter 31. When the sheet-like paper 6 is present in the course of the ultrasonic wave 55, as the number of paper 6 increases, the intensity of the ultrasonic wave 55 passing through the paper 6 decreases. Therefore, the multi-feed detection device 50 can detect multi-feed of the paper 6.

The ultrasonic transmitter 31 has arrayed ultrasonic transmission elements 56. The ultrasonic wave 55 is transmitted with different phases from the ultrasonic transmission elements 56. The ultrasonic waves 55 with different phases interfere with each other and advance in the direction diagonally intersecting the thickness direction of the transmission circuit substrate 51. When advancing the paper 6 in the planar direction with the transmission circuit substrate 51, the reflected wave of the ultrasonic wave 55 reflected on the paper 6 advances in a direction different from the direction of the ultrasonic transmitter 31. Accordingly, it is possible to reduce the interference of the ultrasonic wave 55 transmitted from the ultrasonic transmitter 31 with the reflected wave.

The paper 6 advances in parallel with the transmission circuit substrate 51. Even when the ultrasonic transmitter 31 is not diagonally disposed with respect to the transmission circuit substrate 51, the ultrasonic transmitter 31 transmits the ultrasonic wave 55 in the direction diagonally intersecting the thickness direction of the transmission circuit substrate 51. Compared to when the ultrasonic transmitter 31 is diagonally installed with respect to the transmission circuit substrate 51, the ultrasonic transmitter 31 can be installed with respect to the transmission circuit substrate 51 with high accuracy when the ultrasonic transmitter 31 is not diagonally installed. Accordingly, the multi-feed detection device 50 can accurately install the ultrasonic transmitter 31 which advances the ultrasonic wave 55 diagonally with respect to the advancing direction of the paper 6.

(2) According to the present embodiment, the transmission drive circuit 52 drives the ultrasonic transmission elements 56 to transmit the ultrasonic wave 55 to the ultrasonic transmission elements 56. The transmission drive circuit 52 controls the phase of the ultrasonic wave 55 transmitted from each of the ultrasonic transmission elements 56. By increasing the phase difference of the ultrasonic waves 55 transmitted from the ultrasonic transmission elements 56, the angle at which the advancing direction of the ultrasonic wave 55 intersects the thickness direction of the transmission circuit substrate 51 can be increased. Therefore, the transmission drive circuit 52 can control the advancing direction 55*a* of the ultrasonic wave so that the ultrasonic wave 55 advances toward the ultrasonic receiver 27.

(3) According to the multi-feed detection method of the present embodiment, the ultrasonic transmitter 31 includes a plurality of ultrasonic transmission elements 56. In the ultrasonic receiver 27, a plurality of ultrasonic receiving elements 67 receive the ultrasonic wave 55 transmitted from the ultrasonic transmitter 31. Among the plurality of ultrasonic receiving elements 67, an ultrasonic receiving element 67 which receives the ultrasonic wave 55 with the strongest intensity is referred to as the optimum ultrasonic receiving element 125. When the relative position between the ultrasonic transmitter 31 and the ultrasonic receiver 27 installed in the multi-feed detection device 50 changes, the optimum ultrasonic receiving element 125 changes.

The ultrasonic receiver 27 outputs an electrical signal corresponding to the intensity of the ultrasonic wave 55 received by the optimum ultrasonic receiving element 125. Therefore, even when the relative position between the ultrasonic transmitter 31 and the ultrasonic receiver 27 varies when assembling the ultrasonic transmitter 31 and the ultrasonic receiver 27, it is possible to output an electrical signal corresponding to the ultrasonic wave 55 from the optimum ultrasonic receiving element 125 which receives the ultrasonic wave 55 with the highest intensity. As a result, it is possible to assemble the transmission circuit substrate 51 and the ultrasonic receiver 27 without requiring the positional accuracy of the relative position.

Second Embodiment

Next, an embodiment of a multi-feed detection device installed in a scanner will be described with reference to FIG. 19. The present embodiment is different from the first embodiment in that, the receiving element substrate 65 of the ultrasonic receiver 27 is installed on the receiving circuit substrate 62. The description on the same point as in the first embodiment will be omitted.

Figure 19:
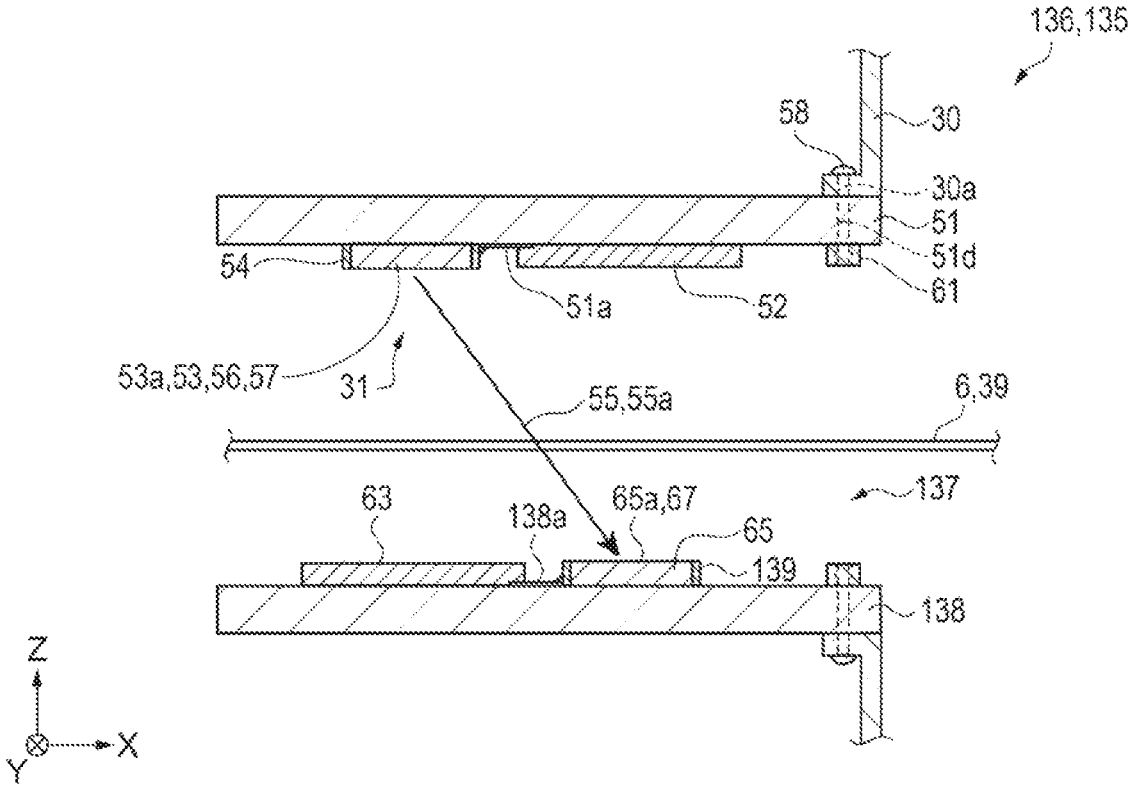
FIG. 19 is a schematic side sectional diagram showing a structure of a multi-feed detection device according to a second embodiment.

FIG. 19 is a schematic side sectional diagram showing a structure of the multi-feed detection device, and is a diagram of the multi-feed detection device seen from the −Y direction side. As shown in FIG. 19, a multi-feed detection device 136 is installed in the transport path 39 of the paper 6 in a scanner 135. The multi-feed detection device 136 of the scanner 135 includes the ultrasonic transmitter 31 and an ultrasonic receiver 137. The ultrasonic transmitter 31, the transmission circuit substrate 51, and the transmission drive circuit 52 are the same as the first embodiment, and a description thereof will be omitted.

The ultrasonic receiver 137 is installed on a receiving circuit substrate 138 as a receiving substrate disposed parallel with the transmission circuit substrate 51. Accordingly, a space can be formed between the receiving circuit substrate 138 and the transmission circuit substrate 51, so that the paper 6 can easily pass between the receiving circuit substrate 138 and the transmission circuit substrate 51.

The ultrasonic receiver 137 includes the receiving element substrate 65, and the receiving element substrate 65 is fixed in contact with the receiving circuit substrate 138. The receiving drive circuit 63 and a wiring 138*a* are installed on the receiving circuit substrate 138. A receiving shield 139 is installed on a side surface of the receiving element substrate 65. The receiving shield 139 is chassis grounded via the wiring 138*a*, and the receiving element substrate 65 is shielded against static electricity and magnetic noise.

On the receiving surface 65*a* of the receiving element substrate 65, the ultrasonic receiving elements 67 are arranged in a matrix as the first embodiment. The ultrasonic receiving elements 67 are arrayed in a direction orthogonal to the thickness direction of the receiving circuit substrate 138. The ultrasonic receiving elements are disposed on the receiving surface 65*a*, and the receiving element substrate 65 is a flat plate. Since the receiving element substrate 65 can be directly disposed on the receiving circuit substrate 138, it is possible to accurately set the position and the orientation of the ultrasonic receiving elements 67 compared to when the receiving pedestal 64 is diagonally installed between the receiving circuit substrate 138 and the receiving element substrate 65.

Third Embodiment

Next, an embodiment of a printing device including the multi-feed detection device 50 or the multi-feed detection device 136 will be described using a schematic side sectional diagram showing a structure of the printing device of FIG. 20. The description on the same point as in the first embodiment and the second embodiment will be omitted.

Figure 20:
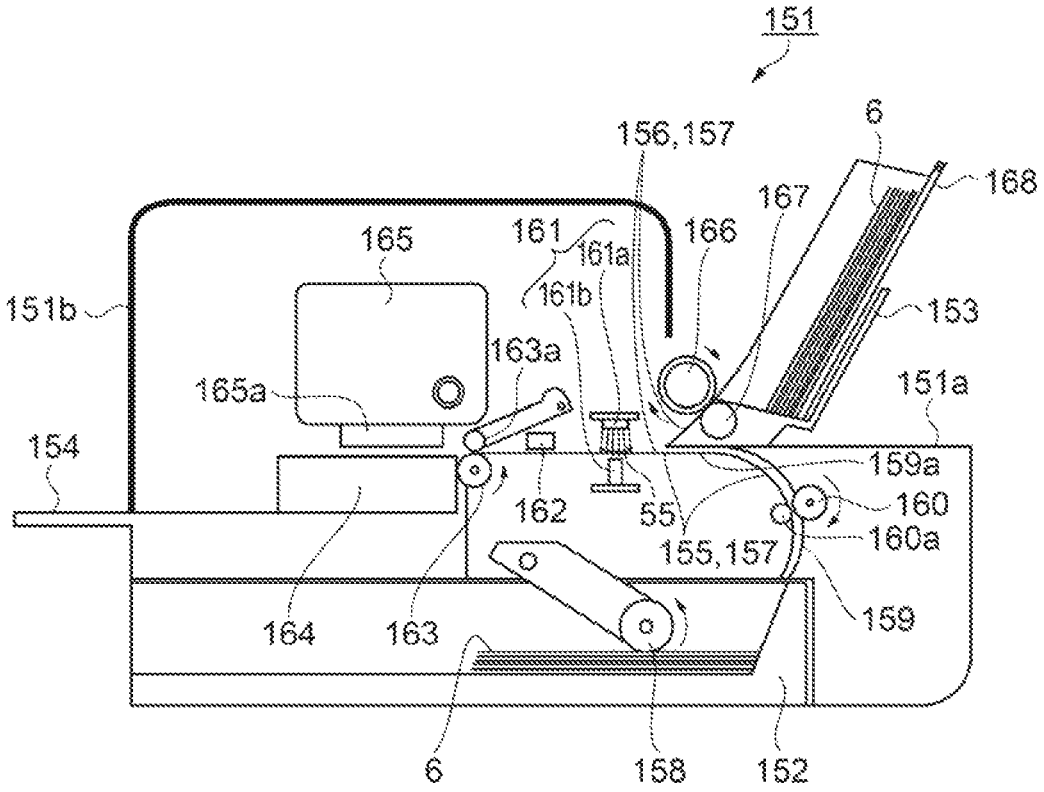
FIG. 20 is a schematic side sectional diagram showing a structure of a printing device according to a third embodiment.

That is, in the present embodiment, as shown in FIG. 20, a printer 151 as an electronic device has a front paper feed tray 152 and a rear paper feed tray 153. The front paper feed tray 152 is installed substantially horizontally on a bottom portion of the printer 151. The rear paper feed tray 153 is disposed on a rear surface 151*a* of the printer 151 so as to protrude to the upper right in FIG. 20. Various types of paper 6 can be placed on the front paper feed tray 152 and the rear paper feed tray 153.

The paper 6 placed on the front paper feed tray 152 and the rear paper feed tray 153 is supplied through a predetermined transport path. The paper 6 is transported along the transport path and is discharged to a paper discharge tray 154 disposed on a front surface 151*b* side of the printer 151. That is, in the printer 151, there are a first transport path 155 of the paper 6 with the front paper feed tray 152 at an upstream position of the transport path, and a second transport path 156 of the paper 6 with the rear paper feed tray 153 at the upstream position of the transport path. A transport path 157 is configured of the first transport path 155 and the second transport path 156.

First, transport of the paper 6 from the first transport path 155 will be described. A pickup roller 158 is provided so that the outer circumference of the pickup roller 158 comes into contact with the paper 6 with respect to the uppermost paper 6 in FIG. 20 among the paper 6 placed on the front paper feed tray 152. The pickup roller 158 is joined with a transport motor, a gear, and the like (not shown). The pickup roller 158 is rotated about a rotation axis parallel to the paper 6 by the driving of the transport motor.

The pickup roller 158 rotates in the counterclockwise direction in FIG. 20 and sends out the paper 6 which comes into contact with the outer circumference of the pickup roller 158 to the rear surface 151*a* side. Then, an end of the paper 6 on the right side of FIG. 20 is guided to a transport guide 159. A portion of the transport guide 159 forms the transport path curved so as to draw a substantially semicircle. The paper 6 is guided to the transport guide 159 and advances to the paper discharge tray 154 side. The paper 6 is supplied to the upper side of FIG. 20 while being bent along the transport guide 159. An intermediate roller 160 is provided in the middle of the curved path of the transport guide 159. The outer circumference of the intermediate roller 160 is in contact with the paper 6 of the transport guide 159 from the right side in FIG. 20, and the intermediate roller 160 rotates about a rotation axis parallel to the paper 6. The intermediate roller 160 is joined with a transport motor, a gear, and the like (not shown), and is rotationally driven actively by the driving of the transport motor. The intermediate roller 160 rotates in a clockwise direction of FIG. 20. An intermediate driven roller 160*a* is provided so as to face the intermediate roller 160 with the paper 6 in between.

The paper 6 is further transported along the transport guide 159 as the intermediate roller 160 is rotationally driven. When a leading end of the paper 6 passes through the curved portion of the transport guide 159, the leading end of the paper 6 advances substantially parallel along a horizontal portion 159*a* of the transport guide 159 toward the front surface 151*b* of the printer 151. When the paper 6 advances substantially horizontally, the paper 6 reaches the multi-feed detection device 161. The multi-feed detection device 161 is installed in the first transport path 155 of the paper 6, and detects whether or not two or more sheets of paper 6 are overlapped. The multi-feed detection device 161 includes an ultrasonic transmitter 161*a* and an ultrasonic receiver 161*b*. The multi-feed detection device 50 or the multi-feed detection device 136 described above is used for the multi-feed detection device 161. The multi-feed detection device 50 and the multi-feed detection device 136 are devices capable of accurately installing the ultrasonic transmitter 161*a* for advancing the ultrasonic wave 55 diagonally with respect to the advancing direction of the paper 6. The printer 151 can be a device including the multi-feed detection device 161 capable of accurately installing the ultrasonic transmitter 161*a* for advancing the ultrasonic wave 55 diagonally with respect to the advancing direction of the paper 6.

When the paper 6 advances to the front surface 151*b* side, the leading end of the paper 6 reaches a paper end sensor 162. The paper end sensor 162 has a light emitting unit and a light receiving unit (not shown). The leading end of the paper can be detected by determining whether or not the paper 6 is interrupting an optical path between the light emitting unit and the light receiving unit. The leading end of the paper is detected by the paper end sensor 162, the transport motor is subsequently driven, and the paper 6 is transported to the downstream of the transport path. A transport roller 163 is provided on the front surface 151*b* side of the paper end sensor 162, and the outer circumference of the transport roller 163 comes into contact with the paper 6 from the lower side. The transport roller 163 is joined with a transport motor, a gear, and the like (not shown), and is rotationally driven by the driving of the transport motor. In FIG. 20, the transport roller 163 rotates in a counterclockwise direction. A transport driven roller 163*a* is provided so as to face the transport roller 163 with the paper 6 in between. When the leading end of the paper reaches the transport roller 163, the paper 6 is transported by the transport roller 163.

A platen 164 is provided on the front surface 151*b* side of the transport roller 163, and the platen 164 supports the transported paper 6 from the below in FIG. 20. A carriage 165 is provided above the platen 164 in FIG. 20 with the paper 6 interposed therebetween. The carriage 165 includes a print head 165*a* on the lower side in FIG. 20. A large number of nozzles are arrayed and installed on a surface on the lower side of the print head 165*a* in FIG. 20, and ink is ejected from each of the nozzles. The carriage 165 moves in a direction perpendicular to the paper surface of FIG. 20. The movement of the carriage 165 in this direction is referred to as main scanning. While the carriage 165 performs main scanning, the print head 165*a* ejects ink on the paper 6. The print head 165*a* can draw a raster line along a main scanning axis with respect to a region facing the nozzles. After performing the main scanning, by driving the transport motor and transporting the paper 6, the printing position on the paper 6 can be shifted. Transporting the paper 6 for drawing is referred to as sub-scanning. By performing sub-scanning on the paper 6, the raster line can be drawn at a position different on the paper 6. By sequentially repeating the main scanning and the sub-scanning, the printer 151 forms a print image on the paper 6. The paper 6 on which the print image is formed is discharged to the paper discharge tray 154. The path through which the paper 6 is transported from the front paper feed tray 152 to the paper discharge tray 154 is the first transport path 155.

Next, transport of the paper 6 through the second transport path 156 will be described. As a mechanism member for supplying the paper 6 placed on the rear paper feed tray 153 to the second transport path 156, the printer 151 has a load roller 166, a load driven roller 167, a hopper 168, and the like. The load roller 166 is disposed so as to be rotatable adjacent to a lower end edge of the rear paper feed tray 153. The load roller 166 is joined with an auto sheet feeder motor, a gear, and the like (not shown). The load roller 166 rotates in a clockwise direction in FIG. 20 by the driving of the auto sheet feeder motor. The load roller 166 and the load driven roller 167 contact each other at a position near the lower end edge of the rear paper feed tray 153.

The hopper 168 is disposed so that the lower side of the rear paper feed tray 153 swings in a direction approaching the load roller 166 and in a direction away from the load roller 166. The hopper 168 approaches the load roller 166 so that the leading end of the uppermost paper 6 on the rear paper feed tray 153 hits the load roller 166, and this paper 6 is interposed between the hopper 168 and the load roller 166. By rotating the load roller 166 in this situation, the paper 6 is sandwiched between the load roller 166 and the load driven roller 167 and transported to the front surface 151*b* side.

The paper 6 transported by the rotation of the load roller 166 passes through the multi-feed detection device 161. The multi-feed detection device 161 is installed in the second transport path 156 of the paper 6, and detects whether or not two or more sheets of paper 6 are overlapped. The multi-feed detection device 161 is the same device as the multi-feed detection device 50 or the multi-feed detection device 136.

Next, the leading end of the paper 6 reaches the paper end sensor 162. The leading end of the paper 6 further transported to the front surface 151*b* side by the rotation of the load roller 166 passes through the paper end sensor 162 and reaches the transport roller 163. The paper 6 is transported on the platen 164 by the transport roller 163. The print image is formed by repeating the main scanning of the carriage 165 and the sub-scanning of the paper 6. The path through which the paper 6 is transported from the rear paper feed tray 153 to the paper discharge tray 154 is the second transport path 156. A transport path 157 is configured of the first transport path 155 and the second transport path 156.

As described above, according to the present embodiment, it has the following effects.

(1) According to the present embodiment, the printer 151 includes the transport path 157. The multi-feed detection device 161 is installed in the transport path 157, and the multi-feed detection device 161 detects whether or not two or more sheets of paper 6 are overlapped. The multi-feed detection device 50 or the multi-feed detection device 136 is used for the multi-feed detection device 161. The multi-feed detection device 50 or the multi-feed detection device 136 is a device capable of reducing the interference of the ultrasonic wave 55 transmitted from the ultrasonic transmitter 31 and the reflected wave. Since the ultrasonic wave 55 transmitted from the ultrasonic transmitter 161*a* does not interfere with the reflected wave, the multi-feed detection device 161 can reliably detect whether or not two or more sheets of paper 6 are overlapped. The multi-feed detection device 50 or the multi-feed detection device 136 is a device capable of accurately installing the ultrasonic transmitter 31 for advancing the ultrasonic wave 55 diagonally with respect to the advancing direction of the paper 6. The printer 151 can be a device including the multi-feed detection device 161 capable of accurately installing the ultrasonic transmitter 161*a* for advancing the ultrasonic wave 55 diagonally with respect to the advancing direction of the paper 6.

The present embodiment is not limited to the above-described embodiments, and various modifications and improvements can be made by those having ordinary knowledge in the art within the technical idea of the present disclosure. Modification examples will be described below.

Modification Example 1

In the first embodiment, the ultrasonic transmitter 31 is installed on the upper substrate 29, and the ultrasonic receiver 27 is installed on the lower substrate 12. The ultrasonic wave 55 is transmitted from the +Z direction side of the paper 6, and the ultrasonic wave 55 is received from the −Z direction side of the paper 6. The positions of the ultrasonic receiver 27 and the ultrasonic transmitter 31 may be exchanged. Here, the multi-feed detection device 50 can detect multi-feed, and can be assembled with high accuracy.

Modification Example 2

In the first embodiment, whether the number of paper 6 passing through the multi-feed detection device 50 is zero, one, or two is detected. The multi-feed detection device 50 may detect a state where three or more sheets of paper 6 are overlapped. Detection suitable for the electronic device may be performed.

Modification Example 3

In the first embodiment, the comparator circuit 111 compares the output voltage of the peak hold circuit 108 with the multi-feed determination voltage 132. The CPU 14 of the control unit 13 may determine whether or not the paper is in a multi-feed state using the output of the A/D converter circuit 112. The multi-feed determination voltage 132 can be easily switched when changing the material of the paper 6.

Modification Example 4

In the first embodiment, the ultrasonic transmission elements 56 of the ultrasonic transmitter 31 are arranged in a matrix. The ultrasonic transmission elements 56 may be arranged in one column in the X direction. Here, the ultrasonic transmitter 31 can transmit the ultrasonic wave 55 toward the ultrasonic receiver 27. In the ultrasonic receiver 27, the ultrasonic receiving elements 67 are arranged in a matrix. The ultrasonic receiving elements 67 may be arranged in one column. Here, the optimum ultrasonic receiving element 125 can be selected from the plurality of ultrasonic receiving elements 67. Only one ultrasonic receiving element 67 can be disposed. Here, the multi-feed detection device 50 can accurately install the ultrasonic transmitter 31 which advances the ultrasonic wave 55 diagonally with respect to the advancing direction of the paper 6. The content of Modification Examples 1 to 4 can be applied to the second embodiment.

Hereinafter, contents derived from the embodiment will be described.

A multi-feed detection device includes a substrate to which an ultrasonic transmitter transmitting an ultrasonic wave is installed, and an ultrasonic receiver receiving the ultrasonic wave, in which the ultrasonic transmitter has arrayed ultrasonic elements and transmits ultrasonic waves with different phases from each of the ultrasonic elements to transmit the ultrasonic wave in a direction diagonally intersecting a thickness direction of the substrate.

According to this configuration, the multi-feed detection device includes a substrate to which an ultrasonic transmitter is installed and an ultrasonic receiver. The ultrasonic receiver receives the ultrasonic wave transmitted from the ultrasonic transmitter. When there is a sheet-like detection target in the course of the ultrasonic wave, as the number of detection targets increases, the intensity of the ultrasonic wave passing through the detection target decreases, so that the multi-feed detection device can detect the number of detection target.

The ultrasonic transmitter has arrayed ultrasonic elements. Each of the ultrasonic elements transmits ultrasonic waves with different phases. The ultrasonic waves with different phases interfere with each other so that the ultrasonic wave advances in the direction diagonally intersecting the thickness direction of the substrate. When advancing the detection target in a planar direction with the substrate, the reflected wave of the ultrasonic wave reflected on the detection target advances in a direction different from the direction in which the ultrasonic transmitter is positioned. Accordingly, it is possible to reduce the interference of the ultrasonic wave transmitted from the ultrasonic transmitter with the reflected wave.

The detection target advances parallel to the substrate. Even when the ultrasonic transmitter is not diagonally disposed with respect to the substrate, the ultrasonic transmitter transmits the ultrasonic wave in the direction diagonally intersecting the thickness direction of the transmission circuit substrate. Compared to when the ultrasonic transmitter is diagonally installed with respect to the substrate, the ultrasonic transmitter can be installed with respect to the substrate with high accuracy when the ultrasonic transmitter is not diagonally installed. Therefore, the multi-feed detection device can advance the ultrasonic wave diagonally with respect to the advancing direction of the detection target even when the ultrasonic transmitter is not diagonally disposed with respect to the substrate.

The multi-feed detection device may further include a drive circuit for driving the ultrasonic elements, in which the drive circuit may control a phase of an ultrasonic wave transmitted from each of the ultrasonic elements to control an advancing direction of the ultrasonic wave.

According to this configuration, the drive circuit drives the ultrasonic element to transmit the ultrasonic wave to the ultrasonic element. The drive circuit controls the phase of the ultrasonic wave transmitted by each ultrasonic element. By increasing the phase difference of the ultrasonic waves transmitted from each ultrasonic element, the angle at which the advancing direction of the ultrasonic wave intersects the thickness direction of the substrate can be increased. Accordingly, the drive circuit can control the advancing direction of the ultrasonic wave so that the ultrasonic wave advances toward the ultrasonic receiver.

In the multi-feed detection device, the ultrasonic receiver may include a plurality of ultrasonic receiving elements, and the plurality of ultrasonic receiving elements may receive the ultrasonic waves transmitted from the ultrasonic transmitter and the ultrasonic receiver may output an electrical signal corresponding to an intensity of the ultrasonic wave received by the ultrasonic receiving element which receives an ultrasonic wave with a strongest intensity among the plurality of ultrasonic receiving elements.

According to this configuration, the ultrasonic receiver includes a plurality of ultrasonic receiving elements. In the ultrasonic receiver, the plurality of ultrasonic receiving elements receive the ultrasonic wave transmitted from the ultrasonic transmitter. The ultrasonic receiving element which receives the ultrasonic wave with the strongest intensity among the plurality of ultrasonic receiving elements is referred to as an optimum ultrasonic receiving element. When the relative position between the ultrasonic transmitter and the ultrasonic receiver installed in the multi-feed detection device changes, the optimum ultrasonic receiving element changes.

The ultrasonic receiver outputs an electrical signal corresponding to the intensity of the ultrasonic wave received by the optimum ultrasonic receiving element. Therefore, even when the relative position between the ultrasonic transmitter and the ultrasonic receiver varies when assembling the ultrasonic transmitter and the ultrasonic receiver, it is possible to output an electrical signal corresponding to the ultrasonic wave from the optimum ultrasonic receiving element which receives the ultrasonic wave with the highest intensity. As a result, the substrate and the ultrasonic receiver can be assembled without requiring the positional accuracy of the relative position.

In the multi-feed detection device, the ultrasonic receiver may be installed on a receiving substrate disposed parallel to the substrate, and the ultrasonic receiving elements are arrayed in a direction orthogonal to a thickness direction of the receiving substrate.

According to this configuration, the ultrasonic receiver is installed on the receiving substrate. The receiving substrate is disposed parallel with the substrate. Therefore, since a space can be formed between the receiving substrate and the substrate, the detection target can easily pass between the receiving substrate and the substrate. The ultrasonic receiving elements of the ultrasonic receiver are arrayed in a direction orthogonal to the thickness direction of the receiving substrate. This configuration can be easily realized by disposing the ultrasonic receiving element on a flat plate. Since the ultrasonic receiving elements of the ultrasonic receiver can be arranged parallel with the receiving substrate, it is possible to accurately set the position and the orientation of the ultrasonic receiving element compared to when a pedestal is diagonally installed between the receiving substrate and the ultrasonic receiving element of the ultrasonic receiver.

The electronic device includes a multi-feed detection device installed in a transport path of a detection target and detecting whether or not two or more of the detection targets are overlapped, in which the multi-feed detection device is the multi-feed detection device described above.

According to this configuration, the electronic device includes a transport path. A multi-feed detection device is installed in the transport path, and the multi-feed detection device detects whether or not two or more detection targets are overlapped. The above-described multi-feed detection device is used for the multi-feed detection device. Accordingly, the multi-feed detection device is a device capable of reducing the ultrasonic wave transmitted from the ultrasonic transmitter interfering with the reflected wave. Since the ultrasonic wave transmitted from the ultrasonic transmitter does not interfere with the reflected wave, the multi-feed detection device can reliably detect whether or not two or more detection targets are overlapped. The multi-feed detection device can accurately install the ultrasonic transmitter advancing the ultrasonic wave diagonally with respect to the advancing direction of the detection target. Therefore, the electronic device can be a device including the multi-feed detection device capable of accurately installing the ultrasonic transmitter advancing the ultrasonic wave diagonally with respect to the advancing direction of the detection target.

What is claimed is:

1. A multi-feed detection device comprising:

a substrate;

an ultrasonic transmitter assembled in the substrate, the ultrasonic transmitter being configured with a plurality of ultrasonic transmitting elements, the plurality of ultrasonic transmitting elements being arranged in a matrix with rows and columns, each of plurality of ultrasonic transmitting elements transmitting an ultrasonic wave;

a drive circuit configured to supply a drive signal to each column of the plurality of ultrasonic transmitting elements at a different time; and an ultrasonic receiver receiving the ultrasonic wave transmitted from each column of the plurality of ultrasonic transmitting elements, the ultrasonic receiver being configured with a plurality of ultrasonic receiving elements, wherein the plurality of ultrasonic transmitting elements in the same column transmit the ultrasonic wave at the same time in response to the drive signal, and the plurality of ultrasonic transmitting elements in the different columns transmit the ultrasonic wave at different times in response to the drive signal, the plurality of ultrasonic receiving elements receive the ultrasonic wave at different timings from respective columns of the plurality of ultrasonic transmitting elements, and the ultrasonic receiver outputs an electrical signal corresponding to an intensity of the ultrasonic wave received by one of the plurality of ultrasonic receiving elements which receives the ultrasonic wave with a strongest intensity among the plurality of ultrasonic receiving elements.

2. The multi-feed detection device according to claim 1, wherein the drive circuit is configured to control the ultrasonic wave transmitted from each column of the plurality of ultrasonic transmitting elements so as to control an advancing direction of the ultrasonic wave.

3. The multi-feed detection device according to claim 1, wherein the ultrasonic receiver is assembled in a receiving substrate disposed parallel to the substrate, and the plurality of ultrasonic receiving elements are arrayed in a direction orthogonal to a thickness direction of the receiving substrate.

4. An electronic device comprising:

a multi-feed detection device installed in a transport path of a detection target and detecting whether or not two or more of the detection targets are overlapped, wherein the multi-feed detection device is the multi-feed detection device according to claim 1.

* * * * *